US010557249B2

(12) United States Patent
Tsuji

(10) Patent No.: US 10,557,249 B2
(45) Date of Patent: Feb. 11, 2020

(54) WHEEL LOADER

(71) Applicant: KOMATSU LTD., Tokyo (JP)

(72) Inventor: Hideki Tsuji, Komatsu (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 15/563,966

(22) PCT Filed: Jul. 19, 2016

(86) PCT No.: PCT/JP2016/071144

§ 371 (c)(1),
(2) Date: Oct. 3, 2017

(87) PCT Pub. No.: WO2017/033623

PCT Pub. Date: Mar. 2, 2017

(65) Prior Publication Data

US 2018/0135273 A1 May 17, 2018

(30) Foreign Application Priority Data

Aug. 24, 2015 (JP) ..... 2015-164480

(51) Int. Cl.
*E02F 3/43* (2006.01)
*E02F 9/20* (2006.01)
*E02F 9/26* (2006.01)

(52) U.S. Cl.
CPC ..... *E02F 3/434* (2013.01); *E02F 9/2029* (2013.01); *E02F 9/261* (2013.01); *E02F 9/264* (2013.01)

(58) Field of Classification Search
CPC ..... E02F 3/434; E02F 9/2029; E02F 9/261; E02F 9/264
See application file for complete search history.

(56) References Cited

U.S. PATENT DOCUMENTS 3,983,707 A * 10/1976 Lezgintsev ..... B63C 11/40 405/190
5,493,798 A 2/1996 Rocke et al.
5,701,691 A * 12/1997 Watanabe ..... E02F 3/435 172/4
5,961,573 A * 10/1999 Hale ..... A01B 79/005 172/4.5
6,032,094 A * 2/2000 Yanagi ..... E02F 3/325 340/440
6,782,644 B2 * 8/2004 Fujishima ..... E02F 3/435 340/679
6,990,390 B2 * 1/2006 Groth ..... E02F 3/435 37/413

(Continued)

FOREIGN PATENT DOCUMENTS

CN 101903839 A 12/2010
EP 3020868 A1 5/2016

(Continued)

*Primary Examiner* — Jamie L McGowan
(74) *Attorney, Agent, or Firm* — Drinker Biddle & Reath LLP

(57) ABSTRACT

A wheel loader includes a work implement, an obtaining unit, and a control unit. The work implement includes a bucket. The obtaining unit obtains soil property information on a soil property of an excavation object. The control unit controls an operation to excavate the excavation object with the bucket of the work implement based on the soil property information obtained by the obtaining unit.

12 Claims, 16 Drawing Sheets

(56) References Cited

U.S. PATENT DOCUMENTS

| | | | | |
|---|---|---|---|---|
| 7,949,449 | B2 * | 5/2011 | Koch | E02F 9/265 37/414 |
| 8,401,746 | B2 * | 3/2013 | Kahle | E02F 3/32 342/463 |
| 9,206,587 | B2 * | 12/2015 | Linstroth | E02F 3/435 |
| 2002/0165656 | A1 | 11/2002 | Adachi et al. | |
| 2008/0127529 | A1 * | 6/2008 | Stanek | E02F 3/435 37/348 |
| 2008/0127531 | A1 * | 6/2008 | Stanek | E02F 9/2004 37/443 |
| 2008/0133093 | A1 * | 6/2008 | Stanek | E02F 9/085 701/50 |
| 2008/0133094 | A1 * | 6/2008 | Stanek | E02F 9/26 701/50 |
| 2008/0282583 | A1 * | 11/2008 | Koellner | E02F 3/304 37/348 |
| 2010/0161183 | A1 * | 6/2010 | Beese | A01B 69/007 701/50 |
| 2010/0245542 | A1 * | 9/2010 | Kim | G01B 11/00 348/46 |
| 2013/0071214 | A1 * | 3/2013 | Itou | B60K 6/48 414/685 |
| 2014/0129114 | A1 | 5/2014 | Nishimura | |
| 2016/0193920 | A1 | 7/2016 | Tsubone et al. | |

FOREIGN PATENT DOCUMENTS

| | | | |
|---|---|---|---|
| JP | H07-268902 | A | 10/1995 |
| JP | H08-49265 | A | 2/1996 |
| JP | H10-273921 | A | 10/1998 |
| JP | 3704092 | B2 | 10/2005 |
| JP | 2008-8183 | A | 1/2008 |
| JP | 2008-133657 | A | 6/2008 |
| JP | 2011-252338 | A | 12/2011 |
| JP | 5343163 | B1 | 11/2013 |
| JP | 2013-248596 | A | 12/2013 |
| JP | 103717860 | A | 4/2014 |
| JP | 5519414 | B2 | 6/2014 |
| JP | 2014-129676 | A | 7/2014 |
| WO | WO 2009/085125 | A1 | 7/2009 |

* cited by examiner (A)

(B)

WHEEL LOADER

TECHNICAL FIELD

The present invention relates to a wheel loader.

BACKGROUND ART

A wheel loader representing a mobile work vehicle includes a traveling apparatus for running a vehicle and a work implement for various works such as excavation. The traveling apparatus and the work implement are driven by drive force from an engine.

In general, a wheel loader often simultaneously performs such works as traveling and loading. For example, in an excavation work, a work implement is pushed into a heap of soil by moving the vehicle forward and the work implement is raised.

The soil is thus scooped in the work implement. Therefore, it is important to allocate power of the engine to the traveling apparatus and the work implement in a balanced manner.

In order to operate the vehicle in a good balance, however, skills are required.

For example, when an unskilled operator excessively presses an accelerator during excavation and excessively pushes the work implement into soil, the vehicle cannot move forward and is stopped. Since drive force for running the vehicle is excessively large in this state, drive force for raising the work implement is lowered. Therefore, even though a work implement operation member is operated to a maximum extent, the work implement cannot be raised. In such a state, in order to protect a hydraulic pump, a hydraulic circuit for supplying a hydraulic oil from the hydraulic pump to the work implement enters a relief state. In such a stall state that the vehicle stalls, a state that engine power is high continues and fuel efficiency becomes poor (an amount of consumption of fuel increases).

An automatically operated wheel loader of which vehicular body automatically travels toward an excavation object such as soil and stones without requiring an operator, of which bucket runs into the excavation object with the traveling operation, and of which bucket and arm are thereafter activated to perform an excavation operation has also been proposed (PTDs 1 and 2).

CITATION LIST

Patent Document

PTD 1: Japanese Patent Laying-Open No. 2008-8183
PTD 2: Japanese Patent Laying-Open No. 2008-133657

SUMMARY OF INVENTION

Technical Problem

In order to efficiently operate a wheel loader, an excavation operation in an excavation attitude in accordance with an excavation object is important. The documents above are silent about this aspect.

The present invention was made to solve the problems above, and an object is to provide a wheel loader capable of performing an efficient excavation operation in an excavation attitude in accordance with an excavation object.

Other tasks and novel features will become apparent from the description herein and the attached drawings.

Solution to Problem

A wheel loader according to one aspect includes a work implement, an obtaining unit, and a control unit. The work implement includes a bucket. The obtaining unit obtains soil property information on a soil property of an excavation object. The control unit controls an operation to excavate the excavation object with the bucket of the work implement based on the soil property information obtained by the obtaining unit.

According to the present invention, the control unit controls an excavation operation based on information on a soil property of an excavation object and therefore an efficient excavation operation in an excavation attitude in accordance with the excavation object can be performed.

Preferably, the obtaining unit obtains moisture information representing an amount of moisture contained in the excavation object. The control unit controls the operation to excavate the excavation object based on the obtained moisture information.

According to the above, the control unit controls an excavation operation based on information on moisture in the excavation object and therefore an efficient excavation operation in an excavation attitude in accordance with the excavation object can be performed.

Preferably, the obtaining unit obtains grain size information representing a grain size of soil of the excavation object. The control unit controls the operation to excavate the excavation object based on the obtained grain size information.

According to the above, the control unit controls an excavation operation based on information on a grain size of the excavation object and therefore an efficient excavation operation in an excavation attitude in accordance with the excavation object can be performed.

Preferably, the wheel loader further includes a display. The control unit has the display show operation guidance for the operation to excavate the excavation object with the bucket of the work implement based on the soil property information obtained by the obtaining unit.

According to the above, the control unit has the display show operation guidance for the excavation operation based on the information on the soil property of the excavation object. Thus, an efficient excavation operation in an excavation attitude in accordance with the excavation object can be performed.

Preferably, the obtaining unit further obtains form information on a form of the bucket. The control unit controls the excavation operation with the bucket of the work implement based on the soil property information and the form information obtained by the obtaining unit.

According to the above, the control unit controls an excavation operation based on the form information on a form of the bucket and the soil property information and therefore an efficient excavation operation in an excavation attitude in accordance with the excavation object can be performed.

Preferably, the wheel loader further includes a sensor which obtains outer geometry data of the bucket. The obtaining unit obtains the form information on the form of the bucket based on the outer geometry data from the sensor.

According to the above, the control unit obtains data on an outer geometry of the bucket with the sensor and hence it can readily obtain outer geometry data.

Preferably, the wheel loader further includes a load calculation unit. The load calculation unit calculates a load imposed on the bucket by excavation of the excavation object. The control unit controls the operation to excavate the excavation object with the bucket of the work implement based on the soil property information obtained by the obtaining unit and a result of calculation by the load calculation unit.

According to the above, since an excavation operation is controlled based on the soil property information and the calculated load imposed by excavation, an efficient excavation operation in an excavation attitude in accordance with the excavation object can be performed.

Preferably, the load calculation unit calculates the load imposed by excavation based on an amount of strain of an attachment pin of the bucket or a pressure of a cylinder of the work implement.

According to the above, the load calculation unit calculates an excavation load based on an amount of strain of the attachment pin of the bucket or a cylinder pressure, and therefore an excavation load can readily be calculated.

A wheel loader according to another aspect includes a work implement, an obtaining unit, and a control unit. The work implement includes a bucket. The obtaining unit obtains form information on a form of the bucket. The control unit controls an operation to excavate an excavation object with the bucket of the work implement based on the form information obtained by the obtaining unit.

According to the above, the control unit controls an excavation operation based on the form information on a form of the bucket, and therefore an efficient excavation operation in an excavation attitude in accordance with the form of the bucket can be performed.

A wheel loader according to yet another aspect includes a work implement, a load calculation unit, and a control unit. The work implement includes a bucket. The load calculation unit calculates a load imposed on the bucket by excavation of an excavation object. The control unit controls an operation to excavate the excavation object with the bucket of the work implement based on a result of calculation by the load calculation unit.

According to the above, the control unit controls an excavation operation based on a load imposed on the bucket by excavation of the excavation object, and therefore an efficient excavation operation in an excavation attitude in accordance with a load imposed on the bucket by excavation of the excavation object can be performed.

Advantageous Effects of Invention

A wheel loader according to the present invention can perform an efficient excavation operation in an excavation attitude in accordance with an excavation object.

DESCRIPTION OF EMBODIMENTS

An embodiment will be described below based on figures.

A wheel loader will be described below with reference to the drawings.

In the description below, "up (above)," "down (below)," "front", "rear", "left", and "right" are terms with an operator seated at an operator's seat being defined as the reference.

First Embodiment

<Overall Configuration>

Figure 1:
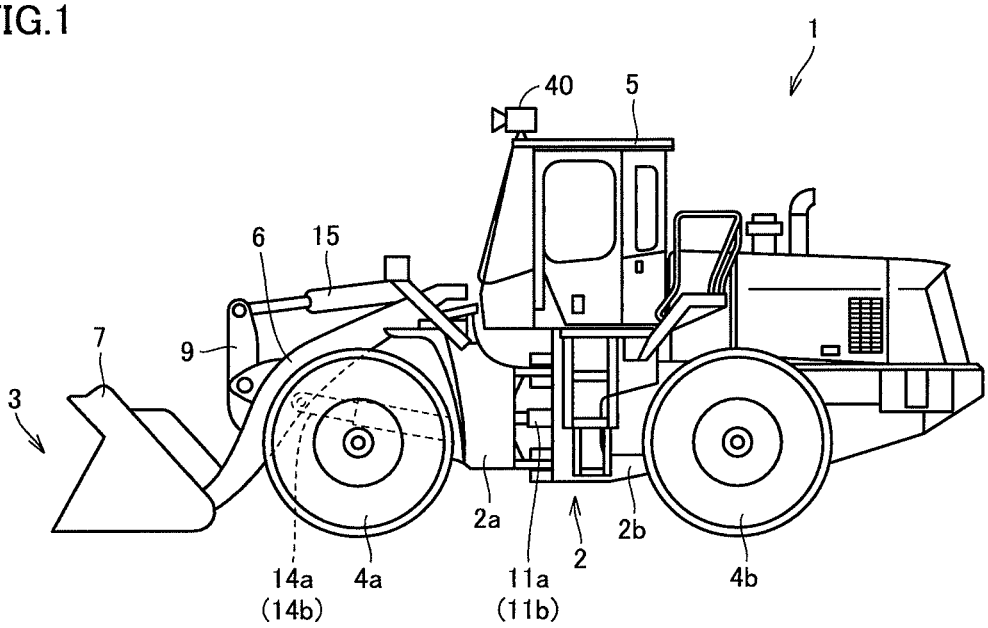
FIG. 1 shows appearance of a wheel loader 1 based on a first embodiment.

FIG. 1 shows appearance of a wheel loader 1 based on a first embodiment.

Figure 2:
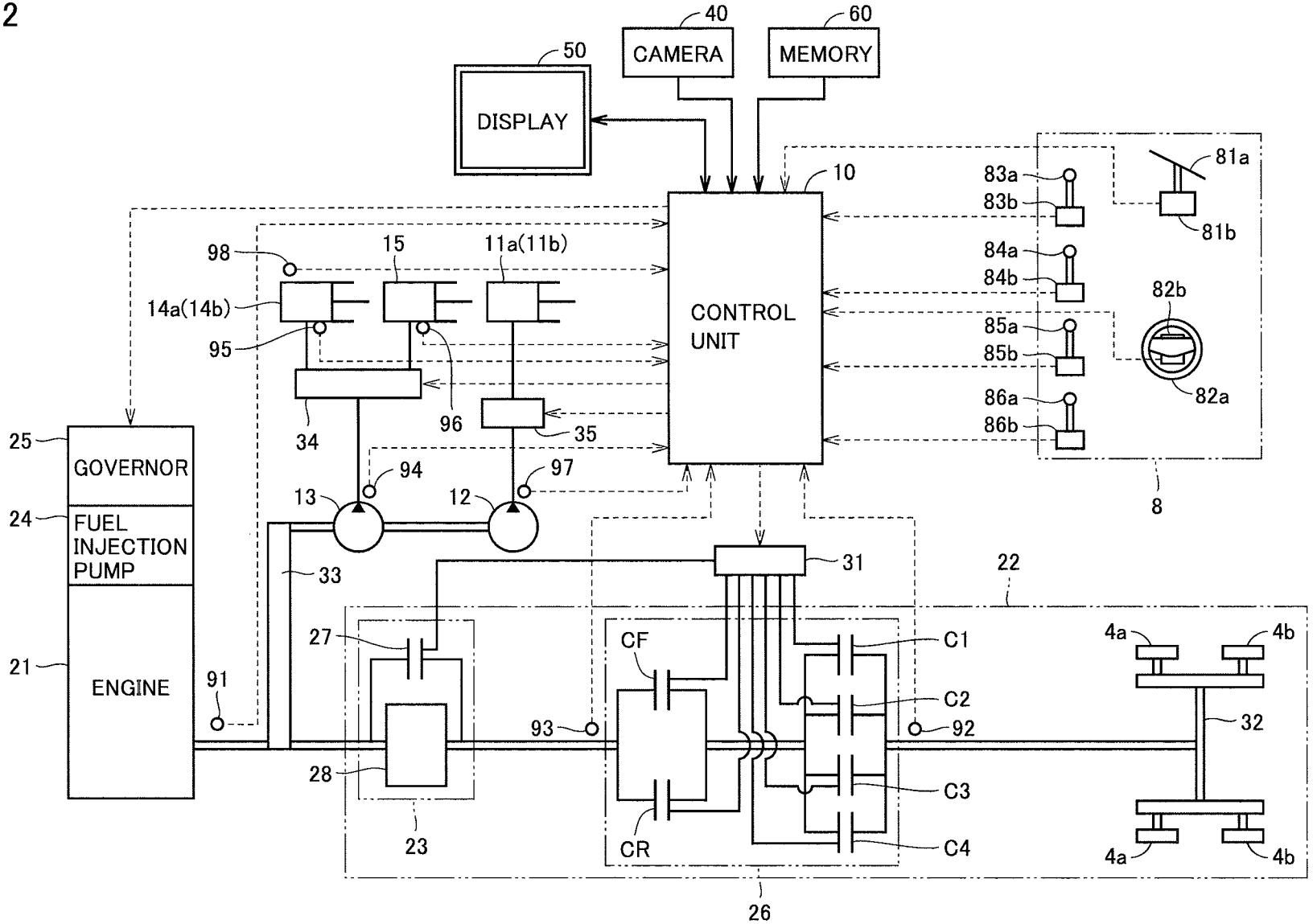
FIG. 2 is a schematic diagram showing a configuration of wheel loader 1 based on the first embodiment.

FIG. 2 is a schematic diagram showing a configuration of wheel loader 1 based on the first embodiment.

As shown in FIGS. 1 and 2, wheel loader 1 is mobile as wheels 4*a* and 4*b* are rotationally driven, and can perform a desired work with a work implement 3.

Wheel loader 1 includes a vehicular body frame 2, work implement 3, wheels 4*a* and 4*b*, and an operator's cab 5.

Vehicular body frame 2 has a front vehicular body portion 2*a* and a rear vehicular body portion 2*b*. Front vehicular body portion 2*a* and rear vehicular body portion 2*b* are coupled to each other in a manner swingable in a lateral direction.

A pair of steering cylinders 11*a* and 11*b* is provided across front vehicular body portion 2*a* and rear vehicular body portion 2*b*. Steering cylinders 11*a* and 11*b* are hydraulic cylinders driven by a hydraulic oil from a steering pump 12 (see FIG. 2). As steering cylinders 11*a* and 11*b* extend and contract, front vehicular body portion 2*a* swings with respect to rear vehicular body portion 2*b*. Thus, a direction of travel of the vehicle is changed.

FIGS. 1 and 2 show only one of steering cylinders 11*a* and 11*b* and do not show the other.

Work implement 3 and a pair of front wheels 4*a* are attached to front vehicular body portion 2*a*. Work implement 3 is driven by the hydraulic oil from a work implement pump 13 (see FIG. 2). Work implement 3 includes a boom 6, a pair of lift cylinders 14*a* and 14*b*, a bucket 7, a bell crank 9, and a bucket cylinder 15.

Boom 6 is rotatably supported by front vehicular body portion 2*a*. Lift cylinders 14*a* and 14*b* have one ends attached to front vehicular body portion 2*a*. Lift cylinders 14*a* and 14*b* have the other ends attached to boom 6. As lift cylinders 14*a* and 14*b* extend and contract owing to the hydraulic oil from work implement pump 13, boom 6 vertically swings.

FIGS. 1 and 2 show only one of lift cylinders 14*a* and 14*b* and do not show the other.

Bucket 7 is rotatably supported at a tip end of boom 6. Bucket cylinder 15 has one end attached to front vehicular body portion 2*a*. Bucket cylinder 15 has the other end attached to bucket 7 with bell crank 9 being interposed. As bucket cylinder 15 extends and contracts owing to the hydraulic oil from work implement pump 13, bucket 7 vertically swings.

Operator's cab 5 and a pair of rear wheels 4*b* are attached to rear vehicular body portion 2*b*. Operator's cab 5 is placed on vehicular body frame 2 and a seat where an operator is seated and an operation portion 8 which will be described later are mounted inside.

As shown in FIG. 2, wheel loader 1 includes an engine 21 as a drive source, a traveling apparatus 22, work implement pump 13, steering pump 12, operation portion 8, and a control unit 10.

Engine 21 is a diesel engine and power of engine 21 is controlled by regulating an amount of fuel injected into a cylinder. Such regulation is achieved by control of an electronic governor 25 attached to a fuel injection pump 24 of engine 21 by control unit 10. Generally, an all speed control type governor is employed as governor 25, and an engine speed and an amount of fuel injection are regulated in accordance with a load such that an engine speed attains to a target speed in accordance with a position of an accelerator which will be described later. Governor 25 increases and decreases an amount of fuel injection such that there is no difference between a target speed and an actual engine speed. An engine speed is detected by an engine speed sensor 91. A detection signal from engine speed sensor 91 is input to control unit 10.

Traveling apparatus 22 is an apparatus for running a vehicle with drive force from engine 21. Traveling apparatus 22 includes a torque converter device 23, a transmission 26, and front wheel 4*a* and rear wheel 4*b* described above.

Torque converter device 23 includes a lock-up clutch 27 and a torque converter 28. Lock-up clutch 27 can switch between a coupled state and a decoupled state. While lock-up clutch 27 is in the decoupled state, torque converter 28 transmits drive force from engine 21 with an oil serving as a medium. While lock-up clutch 27 is in the coupled state, an input side and an output side of torque converter 28 are directly coupled to each other. Lock-up clutch 27 is a hydraulically activated clutch and switching between the coupled state and the decoupled state is made by control of supply of the hydraulic oil to lock-up clutch 27 by control unit 10 with a clutch control valve 31 being interposed.

Transmission 26 includes a forward clutch CF corresponding to a forward drive gear and a reverse clutch CR corresponding to a reverse drive gear. With switching between a coupled state and a decoupled state of each of clutches CF and CR, switching between forward drive and reverse drive of the vehicle is made. While both of clutches CF and CR are in the decoupled state, the vehicle is in a neutral state. Transmission 26 includes a plurality of velocity stage clutches C1 to C4 corresponding to a plurality of velocity stages and can change a reduction gear ratio in a plurality of stages. For example, transmission 26 is provided with four velocity stage clutches C1 to C4 and the velocity stages can be switched among four stages from a first gear to a fourth gear. Each of velocity stage clutches C1 to C4 is a hydraulically activated hydraulic clutch. The hydraulic oil is supplied from a not-shown hydraulic pump through clutch control valve 31 to clutches C1 to C4. Clutch control valve 31 is controlled by control unit 10 to control supply of the hydraulic oil to clutches C1 to C4, so that switching between the coupled state and the decoupled state of each of clutches C1 to C4 is made.

An output shaft of transmission 26 is provided with a T/M output speed sensor 92 which detects a speed of the output shaft of transmission 26. A detection signal from T/M output speed sensor 92 is input to control unit 10. Control unit 10 calculates a vehicle speed based on a detection signal from T/M output speed sensor 92. Therefore, T/M output speed sensor 92 functions as a vehicle speed detection portion which detects a vehicle speed. A sensor which detects a rotation speed of other portions instead of the output shaft of transmission 26 may be employed as a vehicle speed sensor. Drive force output from transmission 26 is transmitted to wheels 4*a* and 4*b* through a shaft 32. The vehicle thus travels. A speed of an input shaft of transmission 26 is detected by a T/M input speed sensor 93. A detection signal from T/M input speed sensor 93 is input to control unit 10.

Some of drive force from engine 21 is transmitted to work implement pump 13 and steering pump 12 through a PTO shaft 33. Work implement pump 13 and steering pump 12 are hydraulic pumps driven by drive force from engine 21. The hydraulic oil delivered from work implement pump 13 is supplied to lift cylinders 14*a* and 14*b* and bucket cylinder 15 through a work implement control valve 34. The hydraulic oil delivered from steering pump 12 is supplied to steering cylinders 11*a* and 11*b* through a steering control valve 35. Thus, work implement 3 is driven by some of drive force from engine 21.

A pressure of the hydraulic oil delivered from work implement pump 13 is detected by a first hydraulic sensor 94. A pressure of the hydraulic oil supplied to lift cylinders 14*a* and 14*b* is detected by a second hydraulic sensor 95. Specifically, second hydraulic sensor 95 detects a hydraulic pressure in a cylinder bottom chamber to which the hydraulic oil is supplied when lift cylinders 14*a* and 14*b* extend. A pressure of the hydraulic oil supplied to bucket cylinder 15 is detected by a third hydraulic sensor 96. Specifically, third hydraulic sensor 96 detects a hydraulic pressure in a cylinder bottom chamber to which the hydraulic oil is supplied when bucket cylinder 15 extends. A pressure of the hydraulic oil delivered from steering pump 12 is detected by a fourth hydraulic sensor 97. Detection signals from first to fourth hydraulic sensors 94 to 97 are input to control unit 10.

Operation portion 8 is operated by an operator. Operation portion 8 includes an accelerator operation member 81*a*, an accelerator operation detection device 81*b*, a steering operation member 82*a*, a steering operation detection device 82*b*, a boom operation member 83*a*, a boom operation detection device 83*b*, a bucket operation member 84*a*, a bucket operation detection device 84*b*, a transmission operation member 85*a*, a transmission operation detection device 85*b*, an FR operation member 86*a*, and an FR operation detection device 86*b*.

Accelerator operation member 81*a* is implemented, for example, by an accelerator pedal and operated in order to set a target speed of engine 21. Accelerator operation detection device 81*b* detects a position of accelerator operation member 81*a*. Accelerator operation detection device 81*b* outputs a detection signal to control unit 10.

Steering operation member 82*a* is implemented, for example, by a steering wheel and operated to operate a direction of travel of a vehicle. Steering operation detection device 82*b* detects a position of steering operation member 82*a* and outputs a detection signal to control unit 10. Control unit 10 controls steering control valve 35 based on a detection signal from steering operation detection device 82*b*. Thus, steering cylinders 11*a* and 11*b* extend and contract and a direction of travel of the vehicle is changed.

Boom operation member 83*a* and bucket operation member 84*a* are implemented, for example, by an operation lever and operated in order to operate work implement 3. Specifically, boom operation member 83*a* is operated to operate boom 6. Bucket operation member 84*a* is operated in order to operate bucket 7. Boom operation detection device 83*b* detects a position of boom operation member 83*a*. Bucket operation detection device 84*b* detects a position of bucket operation member 84*a*. Boom operation detection device 83*b* and bucket operation detection device 84*b* output detection signals to control unit 10. Control unit 10 controls work implement control valve 34 based on detection signals from boom operation detection device 83*b* and bucket operation detection device 84*b*. Thus, lift cylinders 14*a* and 14*b* and bucket cylinder 15 extend and contract and boom 6 and bucket 7 operate. Work implement 3 is provided with a boom angle detection device 98 which detects a boom angle. A boom angle refers to an angle lying between a line connecting a rotation support center of front vehicular body portion 2*a* and boom 6 and a rotation support center of boom 6 and bucket 7 to each other and a line connecting axial centers of front and rear wheels 4*a* and 4*b* to each other. Boom angle detection device 98 outputs a detection signal to control unit 10. Control unit 10 calculates a height position of bucket 7 based on a boom angle detected by boom angle detection device 98. Therefore, boom angle detection device 98 functions as a height position detection portion which detects a height of bucket 7.

Transmission operation member 85*a* is implemented, for example, by a shift lever. Transmission operation member 85*a* is operated in order to set an upper limit of a velocity stage when an automatic transmission mode is selected. For example, when transmission operation member 85*a* is set to the third gear, transmission 26 is changed within a range from the second gear to the third gear and is not set to the fourth gear. When a manual transmission mode is selected, transmission 26 is changed to a velocity stage set with transmission operation member 85*a*. Transmission operation detection device 85*b* detects a position of transmission operation member 85*a*. Transmission operation detection device 85*b* outputs a detection signal to control unit 10. Control unit 10 controls speed change by transmission 26 based on a detection signal from transmission operation detection device 85*b*. Switching between the automatic transmission mode and the manual transmission mode is made by an operator with a not-shown transmission mode switching member.

FR operation member 86*a* is operated to switch between forward drive and reverse drive of the vehicle. FR operation member 86*a* can be set to each of a forward drive position, a neutral position, and a reverse drive position. FR operation detection device 86*b* detects a position of FR operation member 86*a*. FR operation detection device 86*b* outputs a detection signal to control unit 10. Control unit 10 controls clutch control valve 31 based on a detection signal from FR operation detection device 86*b*. Forward clutch CF and reverse clutch CR are thus controlled so that switching among forward drive, reverse drive, and the neutral state of the vehicle is made.

Control unit 10 is generally implemented by reading of various programs by a central processing unit (CPU).

Control unit 10 is connected to a memory 60. Memory 60 functions as a work memory and stores various programs for implementing functions of the wheel loader.

Control unit 10 sends an engine command signal to governor 25 in order to obtain a target speed in accordance with a position of the accelerator.

Control unit 10 is connected to camera 40 and accepts input of image data picked up by camera 40. Camera 40 is provided on a roof side of operator's cab 5 of wheel loader 1.

Control unit 10 is also connected to display 50. Display 50 can show operation guidance to an operator although description will be given later. Display 50 is provided with such an input device as a touch panel, and a command can be given to control unit 10 by operating the touch panel.

<Examples of Excavation Pattern>

The wheel loader in the present first embodiment performs an excavation operation in an excavation attitude in accordance with an excavation object such as soil by way of example.

Figure 3:
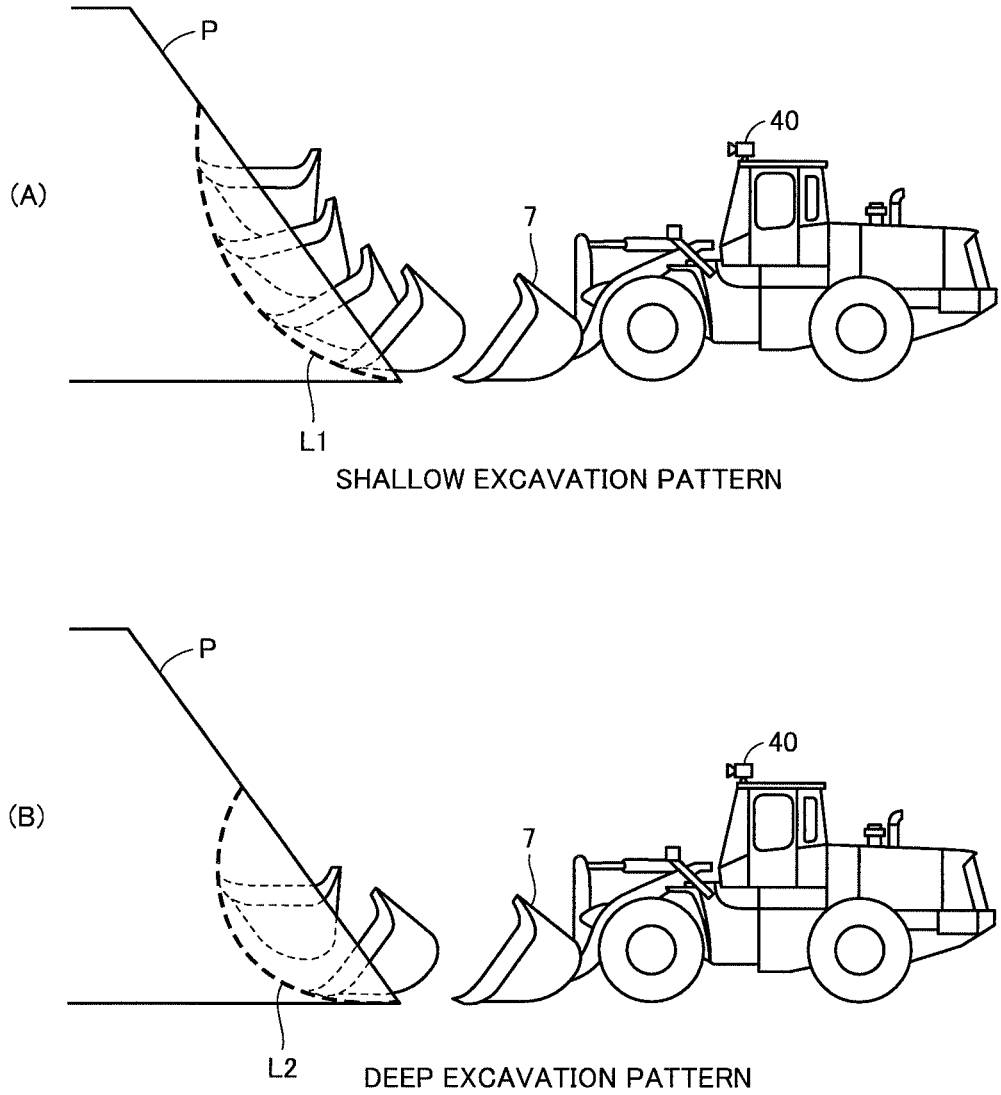
FIG. 3 illustrates an excavation operation with a work implement based on the first embodiment.

FIG. 3 illustrates an excavation operation with the work implement based on the first embodiment.

As shown in FIG. 3 (A), by way of example, bucket 7 performs an operation to excavate an excavation object P along a bucket trace L as an excavation attitude of work implement 3.

Specifically, an excavation operation to raise bucket 7 after a cutting edge of bucket 7 shallowly enters excavation object P is shown (which is also referred to as a shallow excavation pattern).

As shown in FIG. 3 (B), by way of example, bucket 7 performs an operation to excavate excavation object P along a bucket trace L2 as an excavation attitude of work implement 3.

Specifically, an excavation operation to raise bucket 7 after a cutting edge of bucket 7 deeply enters excavation object P is shown (which is also referred to as a deep excavation pattern).

<Example of Soil Property>

Figure 4:
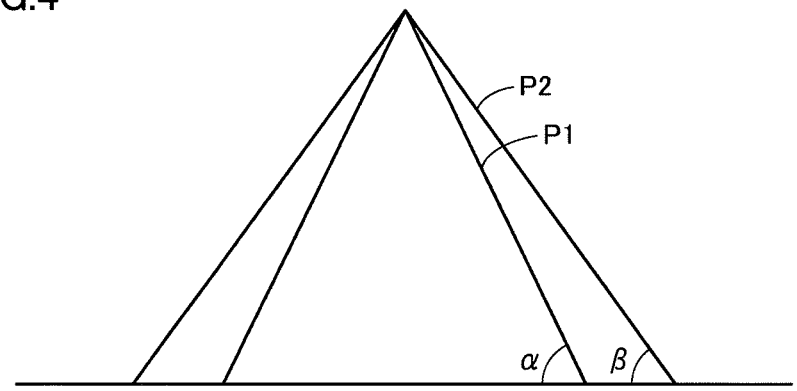
FIG. 4 illustrates examples of excavation objects different in soil property based on the first embodiment.

FIG. 4 illustrates examples of excavation objects different in soil property based on the first embodiment.

As shown in FIG. 4, soil properties of two types of excavation objects P1 and P2 different in grain size of soil from each other are shown as soil properties.

In general, a grain size of a soil property can be estimated by measuring an angle of repose when an excavation object is heaped (deposited). Specifically, an angle of repose is smaller as a grain size is smaller, and an angle of repose is larger as a grain size is larger.

In the present example, by way of example, an angle of repose $\alpha$ of excavation object P1 and an angle of repose $\beta$ of excavation object P2 are shown, with angle of repose $\alpha$ of excavation object P1 being larger than angle of repose $\beta$ of excavation object P2.

Therefore, for example, by measuring an angle of repose, it can be determined as soil property information indicating that excavation object P1 is larger in grain size than excavation object P2.

For example, it can be determined that excavation object P1 has a gravelly soil property large in grain size and excavation object P2 has a sandy soil property small in grain size.

In the present embodiment, an excavation operation is controlled based on information on a soil property of an excavation object. Specifically, when an excavation object has a gravelly soil property, an excavation operation in a shallow excavation pattern can be more efficient than in a deep excavation pattern. A penetration resistance is higher as a grain size is larger. Therefore, in penetration with bucket 7, drive force for running a vehicle more than in an example where a grain size is small is required and sufficient drive force (lift force) for raising the work implement is also required. An excavation object large in grain size is large in angle of repose. Therefore, even in the shallow excavation pattern in which penetration is not deep, an amount of flow into bucket 7 is larger than in an example of an excavation object small in grain size.

In contrast, when an excavation object has a sandy soil property, an excavation operation in the deep excavation pattern is more efficient than in the shallow excavation pattern. A penetration resistance is lower as a grain size is smaller. Therefore, in penetration with bucket 7, drive force for running the vehicle can be reduced as compared with an example where a grain size is large, and drive force (lift force) for raising the work implement can also be reduced. An excavation object small in grain size is small in angle of repose. Therefore, deep penetration is required in order to ensure an amount of flow into bucket 7.

<Configuration of Control System>

Figure 5:
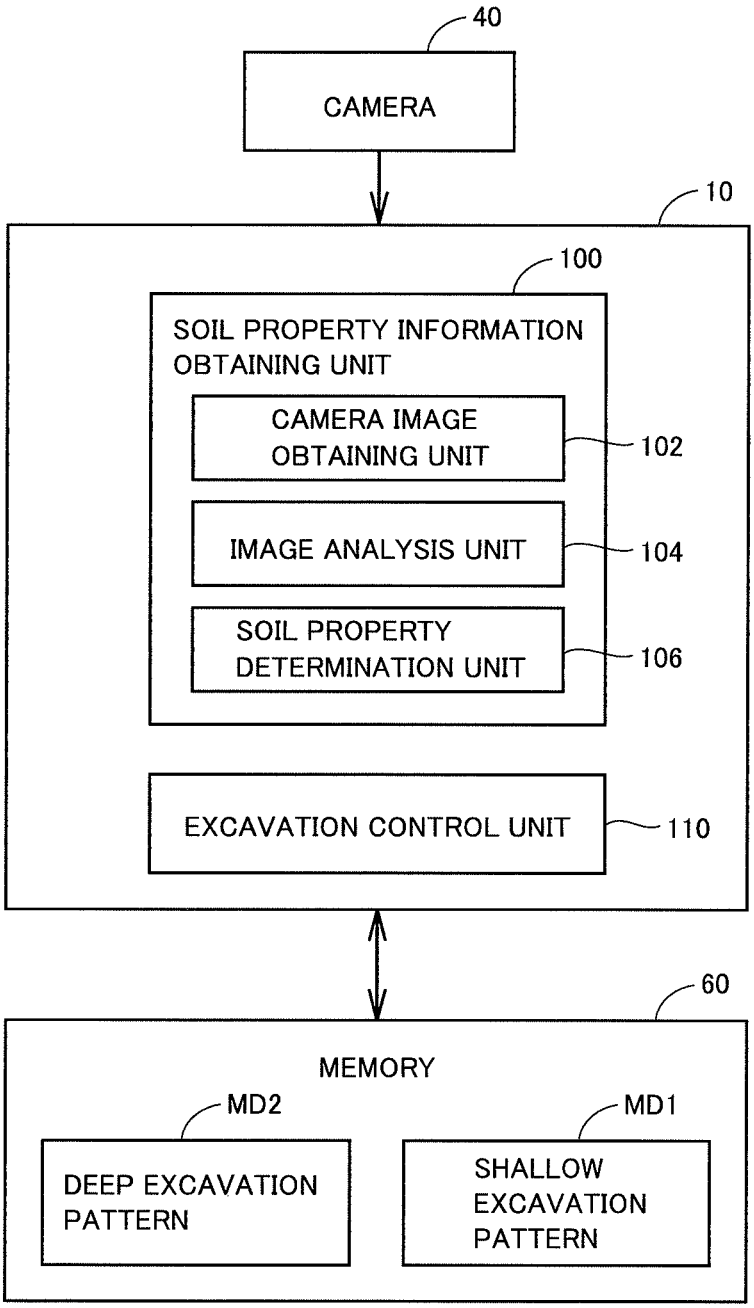
FIG. 5 illustrates a functional configuration of a control unit 10 of wheel loader 1 based on the first embodiment.

FIG. 5 illustrates a functional configuration of control unit 10 of wheel loader 1 based on the first embodiment.

As shown in FIG. 5, control unit 10 is connected to camera 40 and memory 60.

Control unit 10 includes a soil property information obtaining unit 100 and an excavation control unit 110.

Soil property information obtaining unit 100 includes a camera image obtaining unit 102, an image analysis unit 104, and a soil property determination unit 106.

Camera image obtaining unit 102 obtains image data obtained from camera 40. Specifically, camera 40 picks up an image of an excavation object. Camera image obtaining unit 102 obtains image data of the excavation object picked up by camera 40.

Image analysis unit 104 analyzes the image data obtained by camera image obtaining unit 102. Specifically, image analysis unit 104 measures an angle of repose based on the image data of the excavation object.

Soil property determination unit 106 determines a soil property based on a result of analysis of the image data and outputs the result as soil property information to excavation control unit 110. Specifically, soil property determination unit 106 determines a soil property based on the measured angle of repose representing a result of analysis by image analysis unit 104. For example, when the measured angle of repose is equal to or larger than a prescribed threshold value, soil property determination unit 106 determines that a grain size of a soil property of the excavation object is large. When the measured angle of repose is smaller than the prescribed threshold value, soil property determination unit 106 determines that a grain size of a soil property of the excavation object is small. A person skilled in the art could change design of a prescribed threshold value as appropriate.

Excavation control unit 110 controls an excavation operation based on soil property information obtained by soil property information obtaining unit 100.

Memory 60 stores data MD1 for performing an excavation operation along bucket trace L1 (shallow excavation pattern) and data MD2 for performing an excavation operation along bucket trace L2 (deep excavation pattern).

Data MD1 and MD2 are data including various parameters for automatic control of an operation to excavate an excavation object with bucket 7 by wheel loader 1.

Specifically, the data includes data such as a parameter defining a speed of a vehicle in penetration with bucket 7 of work implement 3 for performing an operation to excavate an excavation object in an excavation attitude, a parameter associated with a pressure of a hydraulic oil for ensuring drive force (lifting force) for raising the work implement, and a parameter associated with an engine speed for ensuring drive force for running the vehicle and drive force (lifting force) for raising the work implement. Data calculated in advance through simulation can be employed by way of example. Data corrected through calibration in actual drive may be employed.

When excavation control unit 110 receives determination information indicating that a grain size of an excavation object is small as soil property information from soil property determination unit 106, it has an excavation operation performed in an excavation attitude along bucket trace L2 based on data MD2 (deep excavation pattern).

When excavation control unit 110 receives determination information indicating that a grain size of an excavation object is large as soil property information from soil property determination unit 106, it has an excavation operation performed in an excavation attitude along bucket trace L1 based on data MD1 (shallow excavation pattern).

Through the processing, the wheel loader based on the first embodiment can perform an efficient excavation operation by performing an excavation operation in an excavation attitude of the work implement based on information on the soil property of the excavation object.

Though soil property information obtaining unit 100 in the present example obtains information on a soil property of an excavation object based on image pick-up data from camera 40, limitation to the image pick-up data from camera 40 is not particularly intended and soil property information may be obtained based on other data. For example, the wheel loader may obtain soil property information by accepting an external input of information on a soil property of an excavation object by downloading from an external server connected through a network.

Though soil property information is classified in accordance with a grain size and an excavation operation in an excavation attitude in accordance with the soil property information is performed in the present example, soil property information can further be classified based not only on a grain size but also on a type of a grain so that an excavation operation in an excavation attitude in accordance with the soil property information can also be performed.

(Modification)

Though soil property information obtaining unit 100 obtains information on a soil property (a grain size) of an excavation object based on image data obtained from camera 40 in the first embodiment, limitation thereto is not intended and an amount of moisture can also be estimated as soil property information.

<Configuration of Control System>

Figure 6:
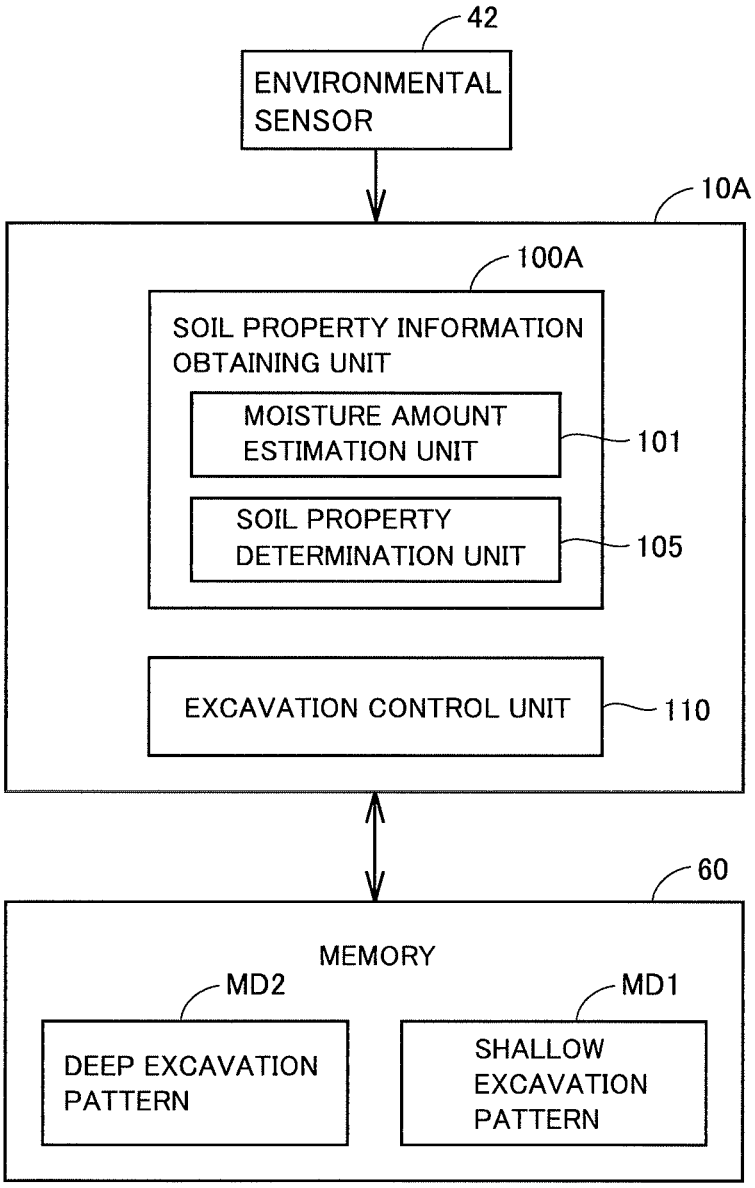
FIG. 6 illustrates a functional configuration of a control unit 10A of wheel loader 1 based on a modification of the first embodiment.

FIG. 6 illustrates a functional configuration of a control unit 10A of wheel loader 1 based on a modification of the first embodiment.

As shown in FIG. 6, control unit 10A is connected to an environmental sensor 42 and memory 60.

Environmental sensor 42 is a sensor for sensing data on a surrounding environment. Specifically, environmental sensor 42 senses at least one of a temperature and a humidity as the data on the surrounding environment.

Control unit 10A includes a soil property information obtaining unit 100A and excavation control unit 110.

Soil property information obtaining unit 100A includes a moisture amount estimation unit 101 and a soil property determination unit 105.

Moisture amount estimation unit 101 obtains environmental data obtained from environmental sensor 42 and estimates an amount of moisture in an excavation object. Specifically, the moisture amount estimation unit estimates an amount of moisture in the excavation object based on environmental data (at least one of a temperature and a humidity) obtained from environmental sensor 42.

Soil property determination unit 105 determines a soil property based on the estimated amount of moisture in the excavation object and outputs the soil property as soil property information to excavation control unit 110. For example, soil property determination unit 105 compares the estimated amount of moisture with a prescribed threshold value and determines whether the amount of moisture in the excavation object is large or small. Then, the soil property determination unit outputs a result of determination to excavation control unit 110 as determination information. A person skilled in the art could change design of a prescribed threshold value as appropriate.

Excavation control unit 110 controls an excavation operation based on soil property information obtained by soil property information obtaining unit 100A.

Memory 60 stores data MD1 for performing an excavation operation along bucket trace L1 (shallow excavation pattern) and data MD2 for performing an excavation operation along bucket trace L2 (deep excavation pattern).

When excavation control unit 110 receives determination information indicating that an amount of moisture in an excavation object is small as soil property information from soil property determination unit 105, it has an excavation operation performed in an excavation attitude along bucket trace L2 based on data MD2 (deep excavation pattern).

When excavation control unit 110 receives determination information indicating that an amount of moisture in an excavation object is large as soil property information from soil property determination unit 105, it has an excavation operation performed in an excavation attitude along bucket trace L1 based on data MD1 (shallow excavation pattern).

Similarly to an example of a grain size of a soil property of an excavation object, when an amount of moisture is large, an efficient excavation operation can be performed with the shallow excavation pattern rather than with the deep excavation pattern. A penetration resistance is higher as an amount of moisture is larger. Therefore, in penetration with bucket 7, drive force for running a vehicle more than in an example where an amount of moisture is small is required and sufficient drive force (lift force) for raising the work implement is also required.

Through the processing, the wheel loader based on the first embodiment can perform an efficient excavation operation based on the information on the soil property of the excavation object.

Though soil property information obtaining unit 100A in the present example obtains information on a soil property of an excavation object based on environmental data from the environmental sensor, limitation to the environmental data is not particularly intended and soil property information may be obtained based on other data. For example, the wheel loader may obtain soil property information by accepting an external input of information on a soil property of an excavation object by downloading from an external server connected through a network. Alternatively, soil property information may be obtained by taking some of an excavation object as a sample and measuring an amount of moisture thereof.

Though an excavation operation in two types of excavation attitudes as bucket traces has been described in the embodiment, limitation thereto is not particularly intended and an excavation operation in more types of excavation attitudes can also be performed.

Second Embodiment

In the first embodiment, wheel loader 1 controls an excavation operation along a bucket trace based on soil property information.

Not only wheel loader 1 controls an excavation operation, but also an excavation operation based on soil property information may be shown as work guidance for an operator.

<Configuration of Control System>

Figure 7:
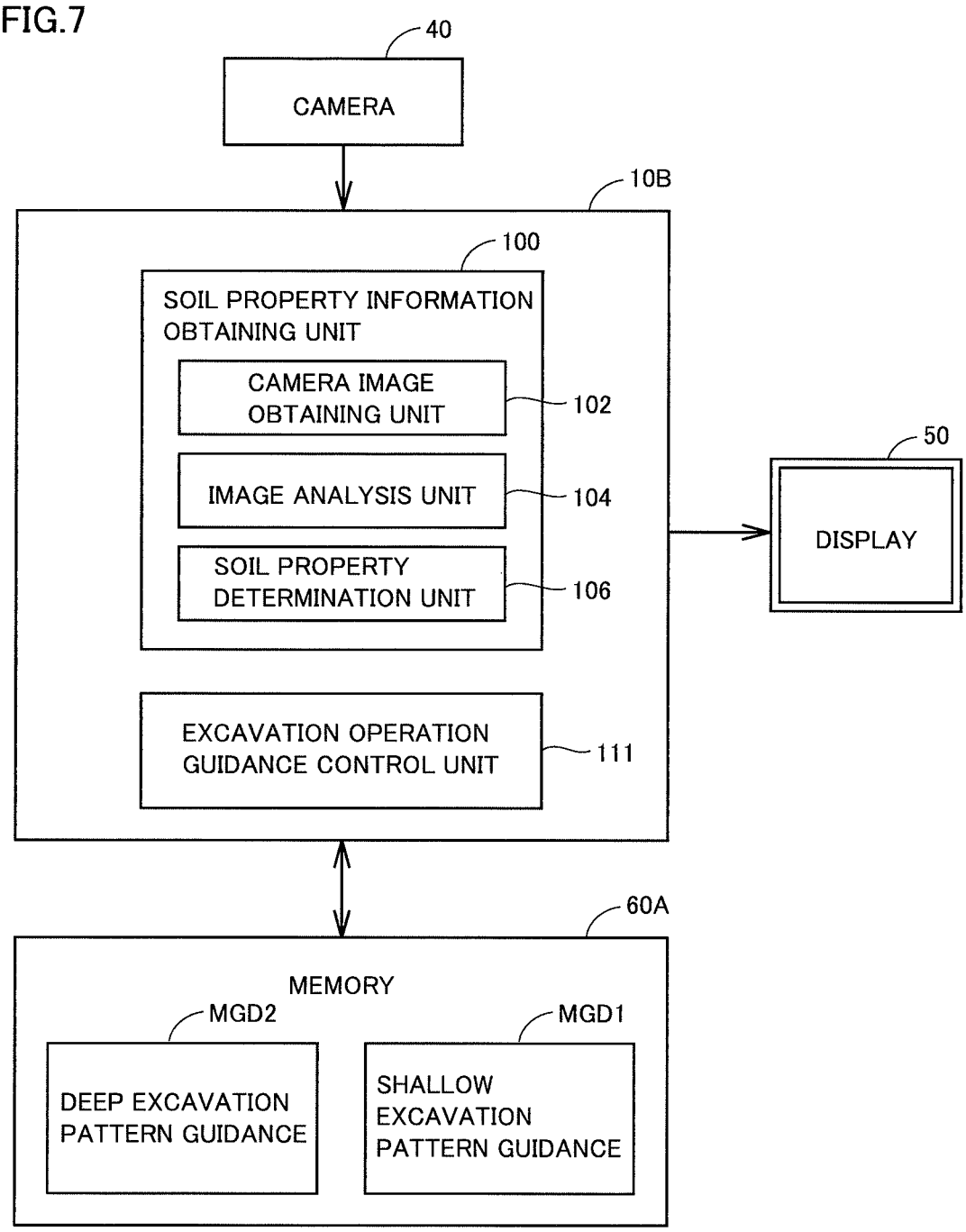
FIG. 7 illustrates a functional configuration of a control unit 10B of wheel loader 1 based on a second embodiment.

FIG. 7 illustrates a functional configuration of a control unit 10B of wheel loader 1 based on a second embodiment.

As shown in FIG. 7, control unit 10B is connected to camera 40, display 50, and a memory 60A.

Control unit 10B includes soil property information obtaining unit 100 and an excavation operation guidance control unit 111.

Soil property information obtaining unit 100 includes camera image obtaining unit 102, image analysis unit 104, and soil property determination unit 106.

Camera image obtaining unit 102 obtains image data obtained from camera 40. Specifically, camera 40 picks up an image of an excavation object. Camera image obtaining unit 102 obtains image data of the excavation object picked up by camera 40.

Image analysis unit 104 analyzes the image data obtained by camera image obtaining unit 102. Specifically, image analysis unit 104 measures an angle of repose based on the image data of the excavation object.

Soil property determination unit 106 determines a soil property based on a result of analysis of the image data and outputs the soil property as soil property information to excavation control unit 110. Specifically, soil property determination unit 106 determines a soil property based on the measured angle of repose representing a result of analysis by image analysis unit 104. For example, when the measured angle of repose is equal to or larger than a prescribed threshold value, soil property determination unit 106 determines that a grain size of a soil property of the excavation object is large. When the measured angle of repose is smaller than the prescribed threshold value, soil property determination unit 106 determines that a grain size of a soil property of the excavation object is small. A person skilled in the art could change design of a prescribed threshold value as appropriate.

Excavation operation guidance control unit 111 has display 50 show operation guidance for an excavation operation based on soil property information obtained by soil property information obtaining unit 100.

Memory 60 stores data MGD1 for showing operation guidance for realizing an excavation operation along bucket trace L1 (shallow excavation pattern) and data MGD 2 for showing operation guidance for realizing an excavation operation along bucket trace L2 (deep excavation pattern).

When excavation operation guidance control unit 111 receives determination information indicating that an excavation object has a large grain size as soil property information from soil property determination unit 106, it has display 50 show operation guidance for performing an excavation operation along bucket trace L1 (shallow excavation pattern) based on data MGD1.

Figure 8:
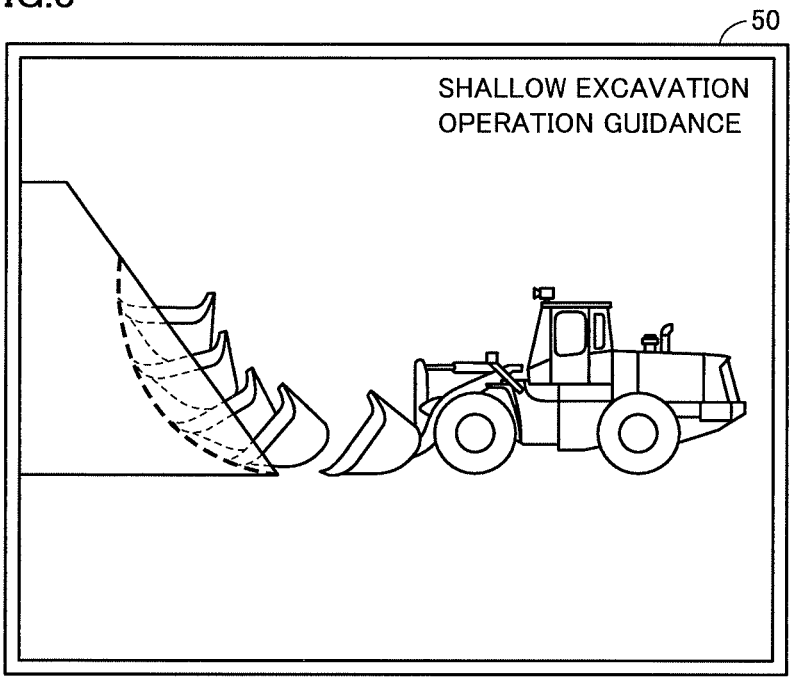
FIG. 8 illustrates representation of operation guidance on a display 50 based on soil property information based on the second embodiment.

FIG. 8 illustrates representation of operation guidance on display 50 based on soil property information based on the second embodiment.

As shown in FIG. 8, operation guidance for realizing an excavation operation along bucket trace L1 (shallow excavation pattern) is shown. By way of example, animated representation of bucket trace L1 of bucket 7 is provided.

As the operation guidance is shown, an operator can know an efficient operation to excavate an excavation object. The operator can thus efficiently operate operation portion 8.

Though a trace of bucket 7 is shown by way of example in the present example as operation guidance, limitation thereto is not intended. For example, guidance on an amount of operation of boom operation member 83*a* and bucket operation member 84*a* can be shown and guidance for a vehicle speed in penetration with the bucket into an excavation object can also be shown.

Through the processing, the wheel loader based on the second embodiment can perform an efficient excavation operation based on the information on the soil property of the excavation object.

Though guidance for an excavation operation in two types of excavation attitudes as bucket traces has been described in the embodiment, limitation thereto is not particularly intended and guidance for an excavation operation in more types of excavation attitudes can also be given.

Third Embodiment

Though wheel loader 1 controls an excavation operation along a bucket trace based on soil property information in the first embodiment, other information can also be made use of together with the soil property information.

Efficient control of an excavation operation based on soil property information and a form of the bucket will be described in the present third embodiment.

Figure 9:
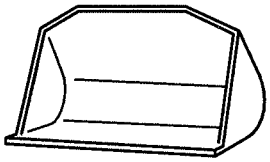
FIG. 9 illustrates a form of a bucket based on the present third embodiment.
Figure 9:
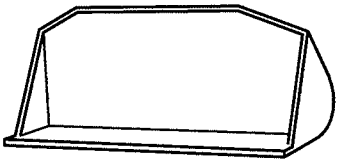

FIG. 9 illustrates a form of the bucket based on the present third embodiment.

As shown in FIGS. 9 (A) and (B), buckets 7A and 7B in a plurality of forms in accordance with applications are provided.

In the present example, by way of example, two buckets 7A and 7B different in size are shown. Bucket 7B is larger in size and volume than bucket 7A.

<Configuration of Control System>

Figure 10:
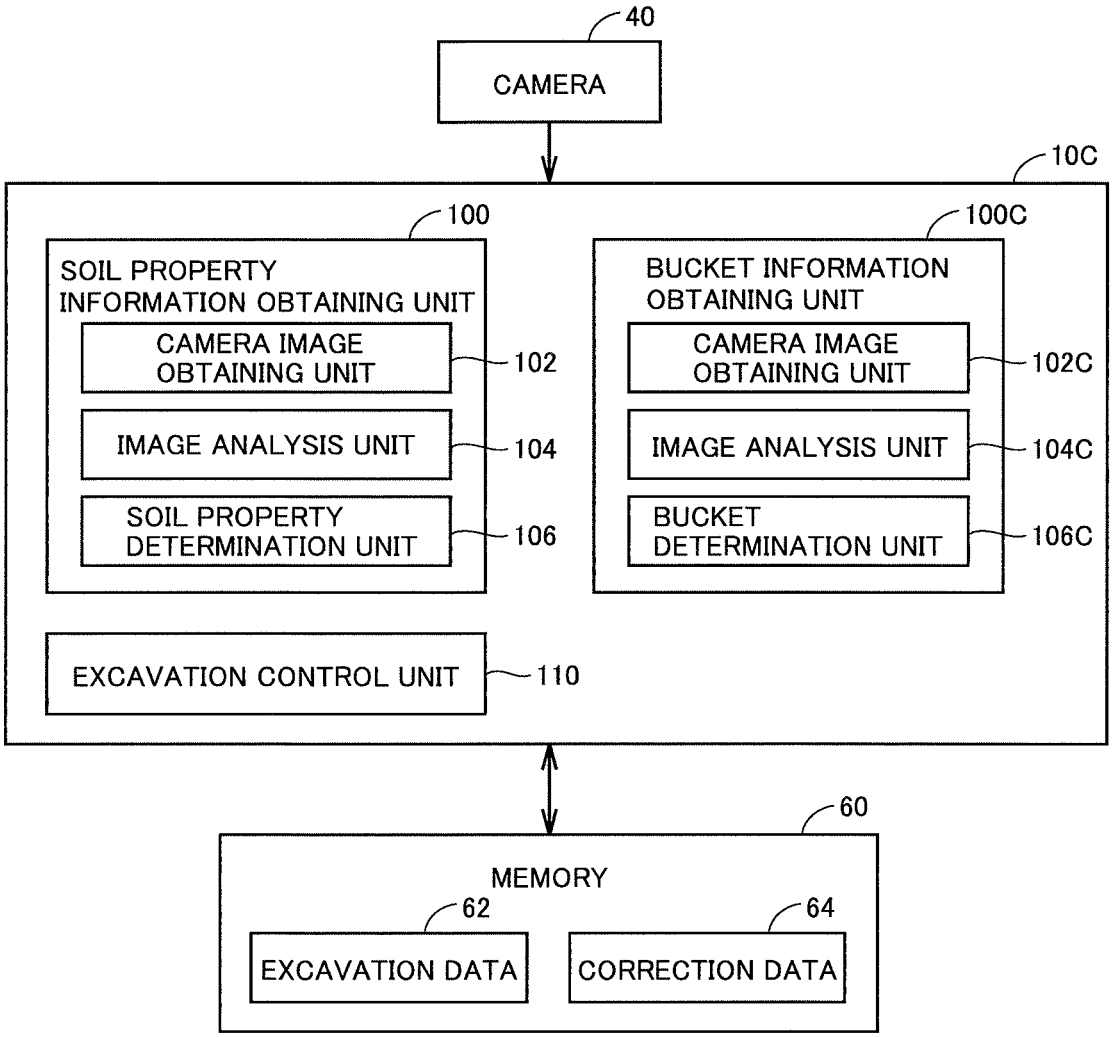
FIG. 10 illustrates a functional configuration of a control unit 10C of wheel loader 1 based on the third embodiment.

FIG. 10 illustrates a functional configuration of a control unit 10C of wheel loader 1 based on the third embodiment.

As shown in FIG. 10, control unit 10C is connected to camera 40 and memory 60.

Control unit 10C includes soil property information obtaining unit 100, a bucket information obtaining unit 100C, and excavation control unit 110.

Since soil property information obtaining unit 100 is the same as described with reference to FIG. 7, detailed description thereof will not be repeated.

Bucket information obtaining unit 100C includes a camera image obtaining unit 102C, an image analysis unit 104C, and a bucket determination unit 106C.

Camera image obtaining unit 102C obtains image data obtained from camera 40. Specifically, camera 40 picks up an image of bucket 7 provided in work implement 3. Camera image obtaining unit 102C obtains image data of bucket 7 picked up by camera 40.

Image analysis unit 104C analyzes the image data obtained by camera image obtaining unit 102. Specifically, image analysis unit 104C measures a form of the bucket based on the image data of bucket 7. Specifically, image analysis unit 104C identifies the bucket in the image data by using pattern matching and measures the form from the identified bucket. Alternatively, model information of the bucket may be obtained from the form of the bucket identified by using pattern matching and information on a dimension such as a length and a height may be obtained based on the model information.

Bucket determination unit 106C determines the bucket based on a result of analysis of the image data and outputs a result of determination as form information to excavation control unit 110. Specifically, bucket determination unit 106C determines whether the bucket is large or small based on the measured form of the bucket representing the result of analysis by image analysis unit 104C. For example, when the measured form of the bucket is equal to or larger than a prescribed size, bucket determination unit 106C determines that the bucket is large. When the measured form of the bucket is smaller than the prescribed size, bucket determination unit 106C determines that the bucket is small. A person skilled in the art could change design of a prescribed size as appropriate.

Excavation control unit 110 controls an excavation operation based on the form information obtained by bucket information obtaining unit 100C.

Memory 60 stores excavation data 62 and correction data 64.

The excavation data includes data such as a parameter defining a speed of a vehicle in penetration with bucket 7 of work implement 3 for performing an operation to excavate an excavation object in an efficient excavation attitude based on soil property information, a parameter associated with a pressure of a hydraulic oil for ensuring drive force (lifting force) for raising the work implement, and a parameter associated with an engine speed for ensuring drive force for running the vehicle and drive force (lifting force) for raising the work implement. Data calculated in advance through simulation can be employed by way of example. Data corrected through calibration in actual drive may be employed. In this connection, data MD1 for performing an excavation operation along bucket trace L1 (shallow excavation pattern) and data MD2 for performing an excavation operation along bucket trace L2 (deep excavation pattern) may be included.

Correction data 64 is necessary for correcting an excavation operation based on a form of the bucket. Specifically, when the form of the bucket is large, an excavation operation is corrected toward the shallow excavation pattern based on the correction data. When the form of the bucket is small, an excavation operation is corrected toward the deep excavation pattern. For example, correction can be made by adjusting a coefficient for weighting various parameters (such as a speed and a pressure).

Excavation control unit 110 determines an excavation operation in an efficient excavation attitude based on soil property information from soil property determination unit 106. Then, the excavation attitude is corrected based on the form information from bucket determination unit 106C. Specifically, when determination information indicating that the form of the bucket is small is received, the bucket trace is corrected toward the deep excavation pattern. When excavation control unit 110 receives determination information indicating that the form of the bucket is large as the form information from bucket determination unit 106C, it corrects the bucket trace toward the shallow excavation pattern.

When the bucket is large as the form of the bucket, an excavation operation can be efficient by making correction toward the shallow excavation pattern rather than toward the deep excavation pattern. When the bucket is small as the form of the bucket, an excavation operation can be efficient by making correction toward the deep excavation pattern rather than toward the shallow excavation pattern. A penetration resistance is higher as the bucket is larger. Therefore, in penetration with bucket 7, drive force for running a vehicle more than in an example where the bucket is small is required and sufficient drive force (lift force) for raising the work implement is also required.

Through the processing, the wheel loader based on the third embodiment can perform an efficient excavation operation based on soil property information and information on a form of the bucket.

Figure 11:
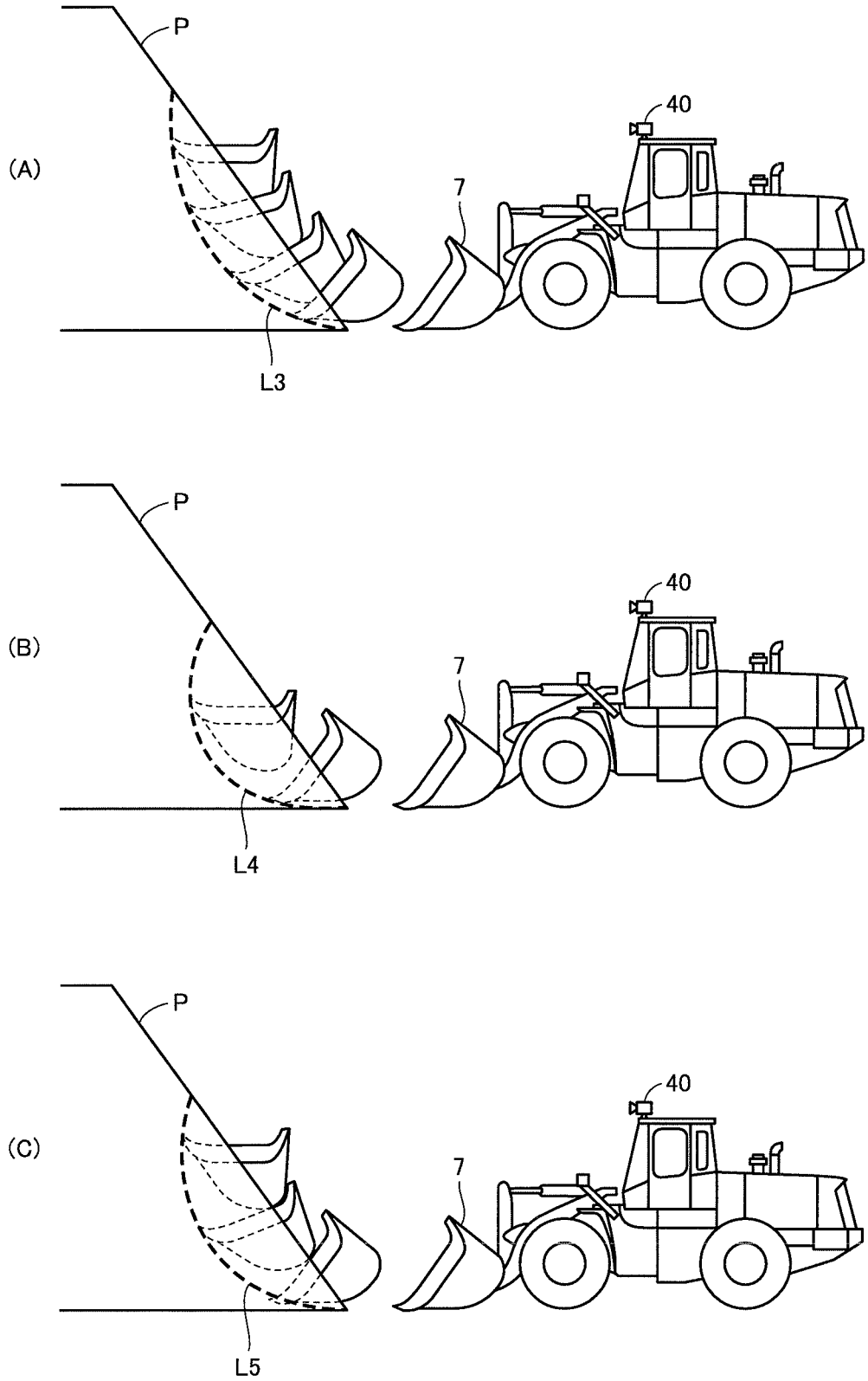
FIG. 11 illustrates an excavation operation (an excavation pattern) based on the third embodiment.

FIG. 11 illustrates an excavation operation (an excavation pattern) based on the third embodiment.

FIG. 11 (A) to (C) shows three types of bucket traces.

By way of example, FIG. 11 (C) shows an operation to excavate excavation object P along a bucket trace L5 determined based on soil property information.

FIGS. 11 (A) and (B) shows an excavation attitude with bucket trace L5 shown in FIG. 11 (C) being corrected.

FIG. 11 (A) shows a corrected excavation operation when the bucket is large by way of example.

Specifically, an excavation operation to raise bucket 7 along a bucket trace L3 after a cutting edge of bucket 7 enters excavation object P to some extent (shallower than in FIG. 11 (C)) is shown.

FIG. 11 (B) shows a corrected excavation operation when the bucket is small by way of example.

Specifically, an excavation operation to raise bucket 7 along a bucket trace L4 after a cutting edge of bucket 7 deeply enters excavation object P (deeper than in FIG. 11 (C)) is shown.

By adjusting an excavation operation as described above, a more efficient excavation operation can be performed.

The first modification of the first embodiment and the second form as well as subsequent embodiments are also similarly applicable.

Though bucket information obtaining unit 100C in the present example obtains a form of the bucket based on image data obtained from camera 40, limitation to image data is not particularly intended and a form of the bucket may be obtained based on other data. For example, the wheel loader may obtain form information by accepting an external input on a form of the bucket by downloading from an external server connected through a network. Alternatively, information on a form of the bucket may be obtained by acceptance of information input on a form of the bucket by an operator.

Figure 12:
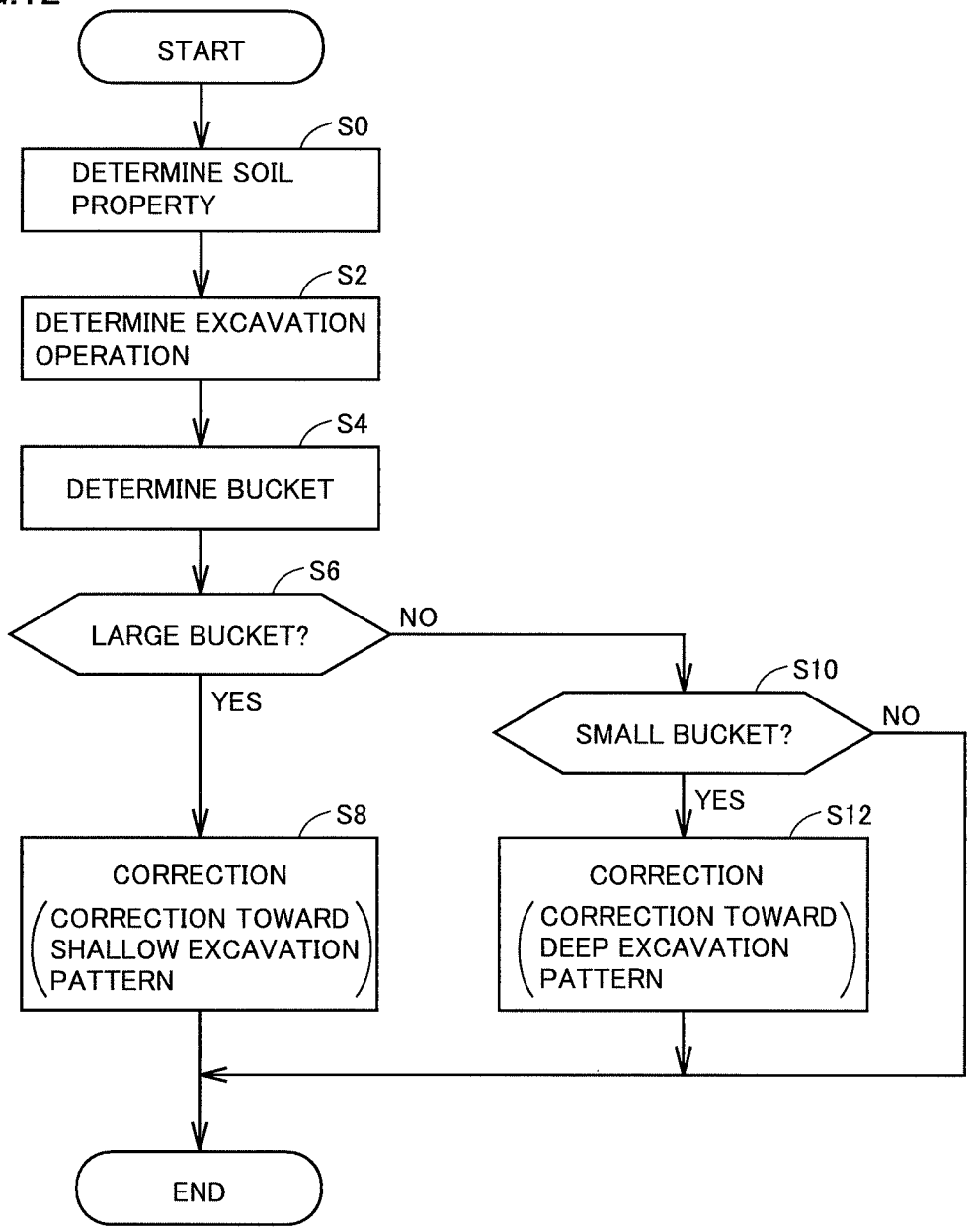
FIG. 12 is a flowchart illustrating a flow of processing in control unit 10C of wheel loader 1 based on the third embodiment.

FIG. 12 is a flowchart illustrating a flow of processing in control unit 100C of wheel loader 1 based on the third embodiment.

As shown in FIG. 12, control unit 10C determines a soil property (step S0). Specifically, soil property determination unit 106 determines a soil property based on a result of analysis of image data as described above. For example, when a measured angle of repose is equal to or larger than a prescribed threshold value, soil property determination unit 106 determines that a grain size of the soil property of an excavation object is large.

Then, control unit 10C determines an excavation operation (step S2). Excavation control unit 110 determines based on soil property information, an excavation operation in an efficient excavation attitude by using excavation data 62 stored in memory 60.

Then, control unit 10C determines a bucket (step S4). Bucket determination unit 106C determines the bucket based on a result of analysis of the image data. Specifically, bucket determination unit 106C determines whether the bucket is large or small based on the measured form of the bucket representing a result of analysis by image analysis unit 104C.

Then, control unit 10C determines whether or not the bucket is large (step S6). For example, bucket determination unit 106C determines whether or not the measured form of the bucket is equal to or larger than a prescribed size.

When control unit 10C determines that the bucket is large (YES in step S6), it corrects an excavation operation (toward the shallow excavation pattern) (step S8). Specifically, when bucket determination unit 106C determines that the measured form of the bucket is equal to or larger than a prescribed size, it outputs that information to excavation control unit 110. Excavation control unit 110 corrects the bucket trace toward the shallow excavation pattern based on correction data 64.

Then, the process ends (end).

When control unit 10C determines that the bucket is not large (NO in step S6), it determines whether or not the bucket is small (step S10). Bucket determination unit 106C determines whether or not the measured form of the bucket is smaller than the prescribed size.

When control unit 10C determines that the bucket is small (YES in step S10), it corrects the excavation operation (toward the deep excavation pattern) (step S12). Specifically, when bucket determination unit 106C determines that the measured form of the bucket is smaller than the prescribed size, it outputs that information to excavation control unit 110. Excavation control unit 110 corrects the bucket trace toward the deep excavation pattern based on correction data 64.

Then, the process ends (end).

When control unit 10C determines that the bucket is not small (NO in step S10), the process ends without change in excavation operation (end).

Through the processing, the wheel loader based on the third embodiment can perform an efficient excavation operation based on the information on the soil property of the excavation object and the form of the bucket.

Fourth Embodiment

<Configuration of Control System>

Figure 13:
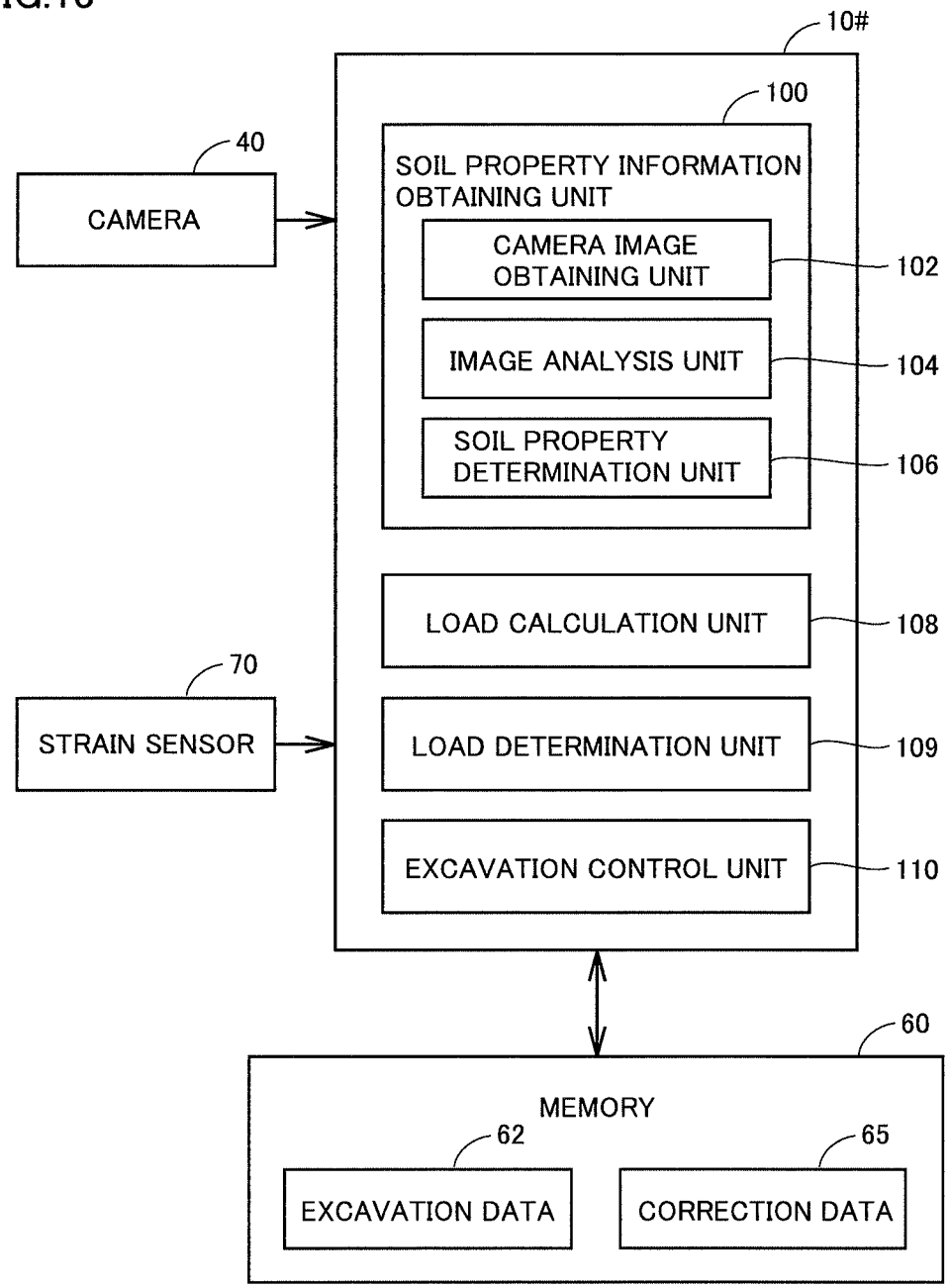
FIG. 13 illustrates a functional configuration of a control unit 10# of wheel loader 1 based on a fourth embodiment.

FIG. 13 illustrates a functional configuration of a control unit 10# of wheel loader 1 based on a fourth embodiment.

As shown in FIG. 13, control unit 10# is connected to camera 40, a strain sensor 70, and memory 60. Strain sensor 70 is provided in an attachment pin of bucket 7.

By way of example, a strain gauge can be provided as strain sensor 70 and it detects excavation reaction force against an excavation object.

Control unit 10# includes soil property information obtaining unit 100, a load calculation unit 108, a load determination unit 109, and excavation control unit 110.

Since soil property information obtaining unit 100 is the same as described with reference to FIG. 7, detailed description thereof will not be repeated.

Load calculation unit 108 calculates a work load based on data from strain sensor 70 (an amount of strain).

Load determination unit 109 determines a level of a load based on the work load calculated by load calculation unit 108.

Excavation control unit 110 controls an excavation operation based on a level of the load determined by load determination unit 109.

Memory 60 stores excavation data 62 and correction data 65.

The excavation data includes data such as a parameter defining a speed of a vehicle in penetration with bucket 7 of work implement 3 for performing an operation to excavate an excavation object in an efficient excavation attitude based on soil property information, a parameter associated with a pressure of a hydraulic oil for ensuring drive force (lifting force) for raising the work implement, and a parameter associated with an engine speed for ensuring drive force for running the vehicle and drive force (lifting force) for raising the work implement. Data calculated in advance through simulation can be employed by way of example. Data corrected through calibration in actual drive may be employed. In this connection, data MD1 for performing an excavation operation along bucket trace L1 (shallow excavation pattern) and data MD2 for performing an excavation operation along bucket trace L2 (deep excavation pattern) may be included.

Correction data 65 is necessary for correcting an excavation operation based on a level of a work load. Specifically, when the level of the work load is high, an excavation operation is corrected toward the shallow excavation pattern based on the correction data. When the level of the work load is low, the excavation operation is corrected toward the deep excavation pattern. For example, correction can be made by adjusting a coefficient for weighting various parameters (such as a speed and a pressure).

Excavation control unit 110 determines an excavation operation in an efficient excavation attitude based on soil property information from soil property determination unit 106. The excavation attitude is corrected based on load information from load determination unit 109. Specifically, when determination information indicating that the level of the work load is low is received, the bucket trace is corrected toward the deep excavation pattern. When excavation control unit 110 receives determination information indicating that the level of the work load is high based on load information from load determination unit 109, it corrects the bucket trace toward the shallow excavation pattern.

When the work load is high as the level of the work load, an excavation operation can be efficient by making correction toward the shallow excavation pattern rather than toward the deep excavation pattern. When the work load is low as the level of the work load, an excavation operation can be efficient by making correction toward the deep excavation pattern rather than toward the shallow excavation pattern. As the work load is higher, sufficient drive force (lifting force) for raising the work implement is required.

Figure 14:
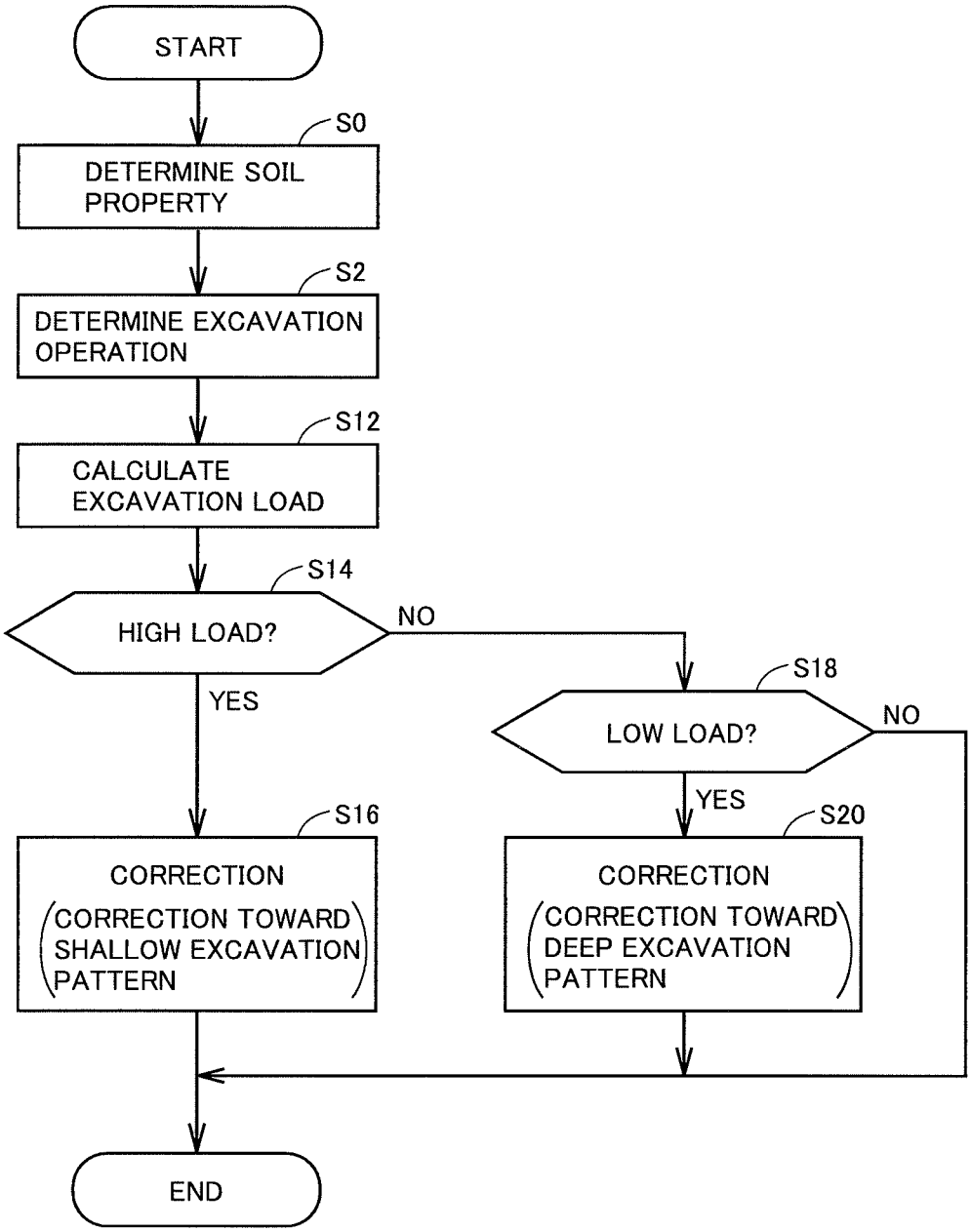
FIG. 14 is a flowchart illustrating a flow of processing in control unit 10# of wheel loader 1 based on the fourth embodiment.

FIG. 14 is a flowchart illustrating a flow of processing in control unit 10# of wheel loader 1 based on the fourth embodiment.

As shown in FIG. 14, control unit 10# determines a soil property (step S0). Specifically, soil property determination unit 106 determines a soil property based on a result of analysis of image data as described above. For example, when a measured angle of repose is equal to or larger than a prescribed threshold value, soil property determination unit 106 determines that a grain size of a soil property of an excavation object is large.

Then, control unit 10C# determines an excavation operation (step S2). Excavation control unit 110 determines based on soil property information, an excavation operation in an efficient excavation attitude by using excavation data 62 stored in memory 60.

Then, control unit 10# calculates an excavation load (step S12). Specifically, load calculation unit 108 calculates an excavation load based on data from strain sensor 70 (an amount of strain).

Then, control unit 10# determines whether or not an excavation load is high (step S14). Specifically, load determination unit 109 determines a level of the excavation load based on the excavation load calculated by load calculation unit 108. For example, load calculation unit 108 determines whether or not the calculated excavation load is within a prescribed range. When the calculated excavation load exceeds the prescribed range, load calculation unit 108 determines that the level of the excavation load is high. When the calculated excavation load is lower than the prescribed range, load calculation unit 108 determines that the level of the excavation load is low. When load calculation unit 108 determines that the calculated excavation load is within the prescribed range, it determines that the level of the excavation load is normal. A person skilled in the art could change design of the prescribed range as appropriate.

When control unit 10# determines in step S14 that the level of the excavation load is high (YES in step S14), it corrects the excavation operation (toward the shallow excavation pattern) (step S16). Specifically, when excavation control unit 110 determines that the level of the excavation load is high as a result of determination by load determination unit 109, it corrects the bucket trace toward the shallow excavation pattern based on correction data 65.

Then, the process ends (end).

When control unit 10# determines in step S14 that the level of the excavation load is not high (NO in step S14), it determines whether or not the level of the excavation load is low (step S18).

When control unit 10# determines in step S18 that the level of the excavation load is low (YES in step S18), it corrects the excavation operation (toward the deep excavation pattern). Specifically, when excavation control unit 110 determines that the level of the excavation load is low as a result of determination by load determination unit 109, it corrects the bucket trace toward the deep excavation pattern based on correction data 65.

Then, the process ends (end).

When control unit 10# determines in step S18 that the level of the excavation load is not low (NO in step S18), the process ends without change in excavation operation (end).

Through the processing, the wheel loader based on the fourth embodiment can perform an efficient operation to excavate an excavation object based on soil property information and an excavation load.

Though an excavation load is calculated based on data from strain sensor 70 (an amount of strain) in the present example, limitation thereto is not intended and an excavation load may be calculated based on a weight of soil excavated with bucket 7. A work load can also be calculated based on a result of detection by a pressure sensor provided in a cylinder of the work implement. A scheme for calculating an excavation load is not limited.

An excavation load is continuously calculated during an excavation operation. Excavation control unit 110 can perform an efficient excavation operation with the bucket trace being corrected based on the calculated excavation load updated any time.

Fifth Embodiment

Though an efficient excavation operation is performed with the use of soil property information in the embodiments, an example in which an efficient excavation operation is performed without using soil property information is described.

<Configuration of Control System>

Figure 15:
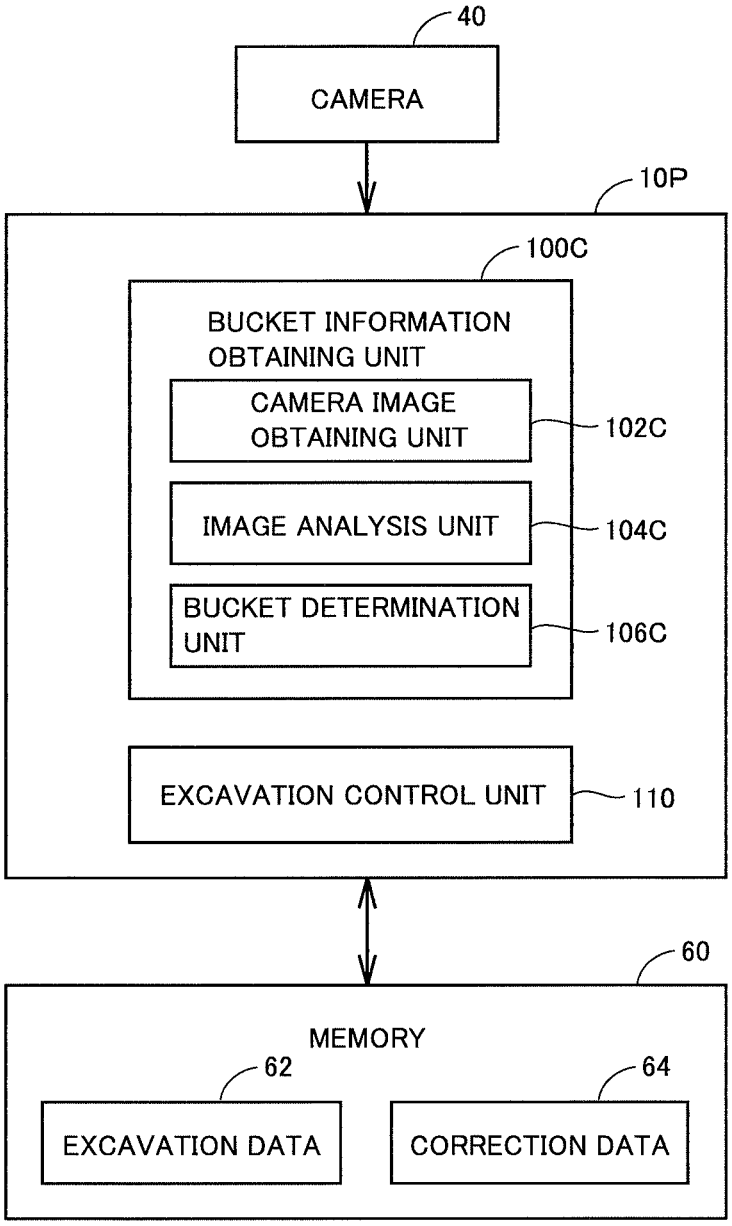
FIG. 15 illustrates a functional configuration of a control unit 10P of wheel loader 1 based on a fifth embodiment.

FIG. 15 illustrates a functional configuration of a control unit 10P of wheel loader 1 based on a fifth embodiment.

As shown in FIG. 15, control unit 10P is connected to camera 40 and memory 60.

Control unit 10P includes bucket information obtaining unit 100C and excavation control unit 110.

Since bucket information obtaining unit 100C is the same as described with reference to FIG. 10, detailed description thereof will not be repeated.

Excavation control unit 110 controls an excavation operation based on form information obtained by bucket information obtaining unit 100C.

Memory 60 stores excavation data 62 and correction data 64.

The excavation data includes data such as a parameter defining a speed of a vehicle in penetration with bucket 7 of work implement 3 for performing an operation to excavate an excavation object in an efficient excavation attitude based on bucket information, a parameter associated with a pressure of a hydraulic oil for ensuring drive force (lifting force) for raising the work implement, and a parameter associated with an engine speed for ensuring drive force for running the vehicle and drive force (lifting force) for raising the work implement. Data calculated in advance through simulation can be employed by way of example. Data corrected through calibration in actual drive may be employed. In this connection, data MD1 for performing an excavation operation along bucket trace L1 (shallow excavation pattern) and data MD2 for performing an excavation operation along bucket trace L2 (deep excavation pattern) may be included.

Correction data 64 is necessary for correcting an excavation operation based on a form of the bucket. Specifically, when the form of the bucket is large, an excavation operation is corrected toward the shallow excavation pattern based on the correction data. When the form of the bucket is small, an excavation operation is corrected toward the deep excavation pattern. For example, correction can be made by adjusting a coefficient for weighting various parameters (such as a speed and a pressure).

Excavation control unit 110 controls an excavation operation based on bucket information obtained by bucket information obtaining unit 100C. Specifically, an excavation attitude is corrected based on the form information from bucket determination unit 106C. When determination information indicating that the form of the bucket is small is received, the bucket trace is corrected toward the deep excavation pattern. When excavation control unit 110 receives determination information indicating that the form of the bucket is large as the form information from bucket determination unit 106C, it corrects the bucket trace toward the shallow excavation pattern.

When the bucket is large as the form of the bucket, an excavation operation can be efficient by making correction toward the shallow excavation pattern rather than toward the deep excavation pattern. When the bucket is small as the form of the bucket, an excavation operation can be efficient by making correction toward the deep excavation pattern rather than toward the shallow excavation pattern. A penetration resistance is higher as the bucket is larger. Therefore, in penetration with bucket 7, drive force for running a vehicle more than in an example where the bucket is small is required and sufficient drive force (lift force) for raising the work implement is also required.

Through the processing, the wheel loader based on the fifth embodiment can perform an efficient excavation operation based on information on a form of the bucket.

Sixth Embodiment

Another example in which an efficient excavation operation is performed without using soil property information will be described.

<Configuration of Control System>

Figure 16:
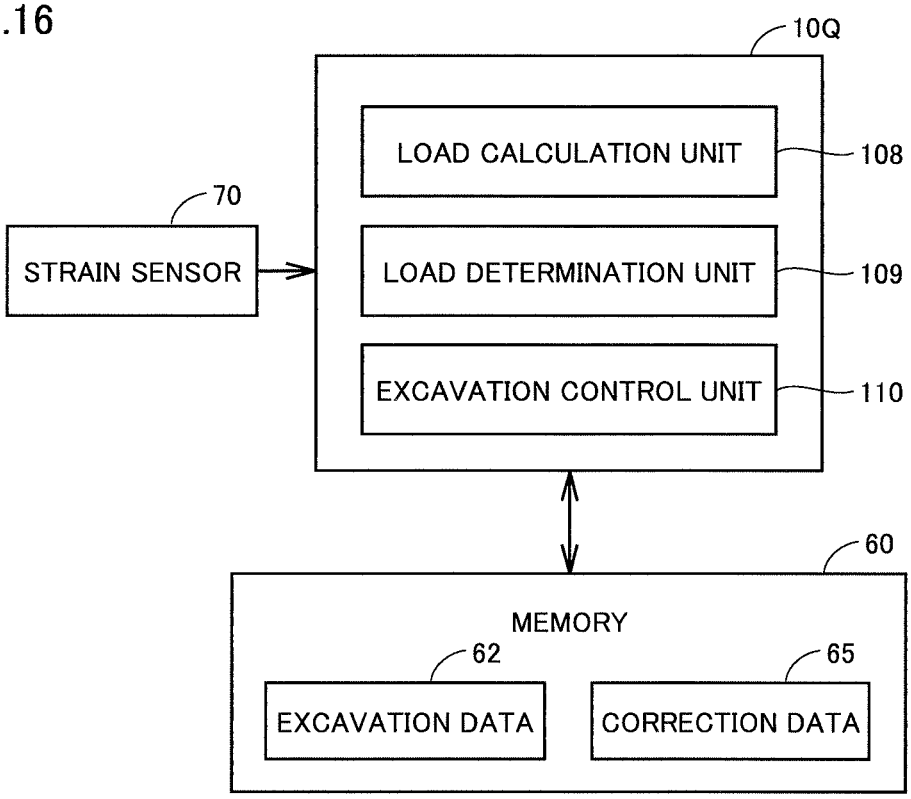
FIG. 16 illustrates a functional configuration of a control unit 10Q of wheel loader 1 based on a sixth embodiment.

FIG. 16 illustrates a functional configuration of a control unit 10Q of wheel loader 1 based on a sixth embodiment.

As shown in FIG. 16, control unit 10Q is connected to camera 40, strain sensor 70, and memory 60. Strain sensor 70 is provided in an attachment pin of bucket 7.

By way of example, a strain gauge can be provided as strain sensor 70 and it detects excavation reaction force against an excavation object.

Control unit 10Q includes load calculation unit 108, load determination unit 109, and excavation control unit 110.

Since load calculation unit 108 and load determination unit 109 are the same as described with reference to FIG. 13, detailed description thereof will not be repeated.

Excavation control unit 110 controls an excavation operation based on a level of a load determined by load determination unit 109.

Memory 60 stores excavation data 62 and correction data 65.

The excavation data includes data such as a parameter defining a speed of a vehicle in penetration with bucket 7 of work implement 3 for performing an operation to excavate an excavation object in an efficient excavation attitude based on load information, a parameter associated with a pressure of a hydraulic oil for ensuring drive force (lifting force) for raising the work implement, and a parameter associated with an engine speed for ensuring drive force for running the vehicle and drive force (lifting force) for raising the work implement. Data calculated in advance through simulation can be employed by way of example. Data corrected through calibration in actual drive may be employed. In this connection, data MD1 for performing an excavation operation along bucket trace L1 (shallow excavation pattern) and data MD2 for performing an excavation operation along bucket trace L2 (deep excavation pattern) may be included.

Correction data 65 is necessary for correcting an excavation operation based on a level of a work load. Specifically, when the level of the work load is high, an excavation operation is corrected toward the shallow excavation pattern based on the correction data. When the level of the work load is low, the excavation operation is corrected toward the deep excavation pattern. For example, correction can be made by adjusting a coefficient for weighting various parameters (such as a speed and a pressure).

Excavation control unit 110 controls an excavation operation based on work load information from load determination unit 109. Specifically, an excavation attitude is corrected based on a level of the work load from load determination unit 109. When determination information indicating that the level of the work load is low is received, the bucket trace is corrected toward the deep excavation pattern. When excavation control unit 110 receives determination information indicating that the level of the work load is high based on load information from load determination unit 109, it corrects the bucket trace toward the shallow excavation pattern.

When the work load is high as the level of the work load, an excavation operation can be efficient by making correction toward the shallow excavation pattern rather than toward the deep excavation pattern. When the work load is low as the level of the work load, an excavation operation can be efficient by making correction toward the deep excavation pattern rather than toward the shallow excavation pattern. As a work load is higher, sufficient drive force (lifting force) for raising the work implement is required.

Through the processing, the wheel loader based on the sixth embodiment can perform an efficient operation to excavate an excavation object based on a work load.

Though embodiments of the present invention have been described above, it should be understood that the embodiments disclosed herein are illustrative and non-restrictive in every respect. The scope of the present invention is defined by the terms of the claims and is intended to include any modifications within the scope and meaning equivalent to the terms of the claims.

REFERENCE SIGNS LIST

1 wheel loader; 2 vehicular body frame; 3 work implement; 4*a*, 4*b* wheel; 5 operator's cab; 6 boom; 7, 7A, 7B bucket; 8 operation portion; 9 bell crank; 10, 10A, 10B, 10C control unit; 11*a*, 11*b* steering cylinder; 12 steering pump; 13 work implement pump; 14*a*, 14*b* lift cylinder; 15 bucket cylinder; 21 engine; 22 traveling apparatus; 23 torque converter device; 24 fuel injection pump; 26 transmission; 27 lock-up clutch; 28 torque converter; 31 clutch control valve; 32 shaft; 33 shaft; 34 work implement control valve; 35 steering control valve; 40 camera; 42 environmental sensor; 50 display; 60, 60A memory; 70 strain sensor; 81*a* accelerator operation member; 81*b* accelerator operation detection device; 82*a* steering operation member; 82*b* steering operation detection device; 83*a* boom operation member; 83*b* boom operation detection device; 84*a* bucket operation member; 84*b* bucket operation detection device; 85*a* transmission operation member; 85*b* transmission operation detection device; 86*a* operation member; 86*b* operation detection device; 91 engine speed sensor; 92 output speed sensor; 93 input speed sensor; 98 boom angle detection device; 100, 100A soil property information obtaining unit; 100C bucket information obtaining unit; 101 moisture amount estimation unit; 102, 102C camera image obtaining unit; 104, 104C image analysis unit; 105, 106 soil property determination unit; 106C bucket determination unit; 108 load calculation unit; 109 load determination unit; 110 excavation control unit; 111 excavation operation guidance control unit

The invention claimed is:

1. A wheel loader comprising:

a work implement including a boom rotatably supported by a vehicular body and a bucket rotatably supported by the boom;

a pair of left and right front wheels and a pair of left and right rear wheels attached to the vehicular body;

an obtaining unit which obtains soil property information on a soil property of an excavation object; and a control unit which controls an operation to excavate the excavation object with the bucket of the work implement by determining a trace of the bucket based on the soil property information obtained by the obtaining unit and moving based on the trace, the bucket into the excavation object in a forward moving direction of the wheel loader.

2. The wheel loader according to claim 1, wherein the soil property information is obtained from image pick-up data.

3. The wheel loader according to claim 2, the wheel loader comprising a camera which obtains the image pick-up data.

4. The wheel loader according to claim 1, wherein the obtaining unit obtains moisture information representing an amount of moisture contained in the excavation object, and the control unit controls the operation to excavate the excavation object based on the obtained moisture information.

5. The wheel loader according to claim 1, wherein the obtaining unit obtains grain size information representing a grain size of soil of the excavation object, and the control unit controls the operation to excavate the excavation object based on the obtained grain size information.

6. The wheel loader according to claim 1, the wheel loader further comprising a display, wherein the control unit has the display show operation guidance for the operation to excavate the excavation object with the bucket of the work implement based on the soil property information obtained by the obtaining unit.

7. The wheel loader according to claim 1, wherein the obtaining unit further obtains form information on a form of the bucket, and the control unit controls an excavation operation with the bucket of the work implement based on the soil property information and the form information obtained by the obtaining unit.

8. The wheel loader according to claim 7, the wheel loader further comprising a sensor which obtains outer geometry data of the bucket, wherein the obtaining unit obtains the form information on the form of the bucket based on the outer geometry data from the sensor.

9. The wheel loader according to claim 1, the wheel loader further comprising a load calculation unit which calculates a load imposed on the bucket by excavation of the excavation object, wherein the control unit controls the operation to excavate the excavation object with the bucket of the work implement based on the soil property information obtained by the obtaining unit and a result of calculation by the load calculation unit.

10. The wheel loader according to claim 9, wherein the load calculation unit calculates the load imposed by excavation based on an amount of strain of an attachment pin of the bucket or a pressure of a cylinder of the work implement.

11. A wheel loader comprising:

a work implement including a boom rotatably supported by a vehicular body and a bucket rotatably supported by the boom;

a pair of left and right front wheels and a pair of left and right rear wheels attached to the vehicular body;

an obtaining unit which obtains form information on a form of the bucket; and a control unit which controls an operation to excavate the excavation object with the bucket of the work implement by determining a trace of the bucket based on the form information obtained by the obtaining unit and moving based on the trace, the bucket into the excavation object in a forward moving direction of the wheel loader.

12. A wheel loader comprising:

a work implement including a boom rotatably supported by a vehicular body and a bucket rotatably supported by the boom;

a pair of left and right front wheels and a pair of left and right rear wheels attached to the vehicular body;

a load calculation unit which calculates a load imposed on the bucket by excavation of an excavation object; and a control unit which controls an operation to excavate the excavation object with the bucket of the work implement by determining a trace of the bucket based on the load calculated by the load calculation unit and moving based on the trace, the bucket into the excavation object in a forward moving direction of the wheel loader.

* * * * *